US005820006A

United States Patent [19]

Turner

[11] Patent Number: 5,820,006

[45] Date of Patent: Oct. 13, 1998

[54] APPARATUS FOR SCRIBING AND/OR BREAKING SEMICONDUCTOR WAFERS

[75] Inventor: James R. Turner, Sebastopol, Calif.

[73] Assignee: Dynatex International, Inc., Santa Rosa, Calif.

[21] Appl. No.: 624,339

[22] Filed: Apr. 3, 1996

Related U.S. Application Data

[63] Continuation of Ser. No. 183,613, Jan. 18, 1994, abandoned.

[51] Int. Cl.[6] ..... B26F 3/00

[52] U.S. Cl. ..... 225/96; 225/96.5; 225/103; 83/882

[58] Field of Search ..... 225/2, 96, 96.5, 225/103, 104; 83/879, 880, 882; 125/23.01, 23.02; 29/413, 414, 417

[56] References Cited

U.S. PATENT DOCUMENTS

| | | | |
|---|---|---|---|
| 2,970,730 | 2/1961 | Schware | 225/2 |
| 3,920,168 | 11/1975 | Regan et al. | 225/96.5 X |
| 4,095,344 | 6/1978 | Loomis | 33/18.1 |
| 4,296,542 | 10/1981 | Gotman | 225/96 X |
| 4,653,680 | 3/1987 | Regan | 225/104 |
| 4,688,540 | 8/1987 | Ono | 125/13.01 |
| 4,698,088 | 10/1987 | Bando | 225/96.5 X |
| 5,165,585 | 11/1992 | Lisec | 225/2 |
| 5,174,188 | 12/1992 | Petroz | 225/96 X |
| 5,275,077 | 1/1994 | Kobayashi | 83/880 |
| 5,327,625 | 7/1994 | Clark, Jr. et al. | 125/23.01 X |

FOREIGN PATENT DOCUMENTS

| | | | |
|---|---|---|---|
| 2050488 | 6/1972 | Germany | 83/879 |

*Primary Examiner*—Eugenia Jones
*Attorney, Agent, or Firm*—Townsend and Townsend and Crew, LLP

[57] ABSTRACT

Apparatus for automatic scribing and breaking of semiconductor wafers wherein scribing is performed at a scribing station and the scribed wafer transported in the X direction to a breaking station on an X-Y table. Scribing and breaking of parallel lines is accomplished by transporting the wafer step-wise in the Y direction by the Y table. Rotation of the wafer for scribing and breaking along sets of lines perpendicular to one another is accomplished by a theta table carried on the Y table. An impulse bar is carried by the X table for applying force to the bottom surface of the wafer during both scribing and breaking. In one embodiment, upward movement of the wafer during breaking is resisted by an anvil positioned above the wafer. In a second embodiment, such upward movement is resisted by a vacuum chuck beneath the wafer, to avoid contact with the upper wafer surface. Scribing and breaking parameters needed to scribe and break the wafer are entered into computer memory and operated upon by computer controls to automate the scribing and/or breaking process. In one embodiment, scribing and breaking of a single wafer is carried out continuously on the same apparatus without operator intervention.

13 Claims, 12 Drawing Sheets

APPARATUS FOR SCRIBING AND/OR BREAKING SEMICONDUCTOR WAFERS

This is a continuation of application Ser. No. 08/183,613, filed Jan. 18, 1994, now abandoned.

BACKGROUND OF THE INVENTION

The present invention relates generally to the field of materials processing and more particularly to an apparatus and method for scribing and breaking semiconductor wafers and the like into individual dies.

In the manufacture of microelectronic devices such as integrated circuits several hundred or more such devices are fabricated on a single semiconductor wafer. The wafer is separated into individual devices utilizing semiconductor scribing and breaking equipment.

Wafer separating equipment includes rotary saws for sawing wafers, as well as sharp pointed scribes. Both saws and scribes may be drawn across the wafer surface to scribe a line or lines along which the wafer is eventually broken into individual dies, as described. An example of the sharp-pointed-scribe-type separating apparatus is shown and described in U.S. Pat. No. 4,095,344, "Scribe Tool And Mount Therefor", of James W. Loomis.

Wafer breaking equipment includes that shown and described in U.S. Pat. No. 3,920,168, "Apparatus For Breaking Semiconductor Wafers", by Barrie F. Regan, et al.; and U.S. Pat. No. 4,653,680, "Apparatus For Breaking Semiconductor Wafers And The Like" by Barrie F. Regan.

SUMMARY OF THE INVENTION

The scriber/breaker apparatus of the present invention is essentially comprised of an X-table, mounted on a base unit, movable back and forth in the X-direction under computerized control of an X-direction motor. A Y-table is mounted atop the X-table, and is movable back and forth, relative to the X-table, in the Y-direction under computerized control of a Y-direction motor. A wafer-holding chuck is mounted on the Y-table for rotational movement about an axis perpendicular to the surfaces of the X and Y tables, under computerized control of a theta-direction motor. This wafer-holding chuck is sometimes hereinafter referred to as the "theta table", owing to its angular rotation. The wafer-holding chuck is essentially an annular ring mounted above a chamber cavity formed in the X and Y-tables. The X-table carries the Y-table and wafer-holding chuck for movement along the X-axis between two separate stations: the scribing station and the breaking station. At the scribing station, a scribe module is mounted above the wafer-holding chuck. At the breaking station, an anvil is located above the wafer-holding chuck. An impulse bar with a straight sharp upper edge mounted beneath the wafer-holding chuck is carried by the X-table along with the wafer chuck, to both scribe and break stations.

During scribing, the wafer-holding chuck carries a wafer to the scribing station at which time the upper sharp edge of the impulse bar rises to apply force against the bottom surface of the wafer along a line in the X-direction and place the top surface of the wafer under tension. While the top surface of the wafer is under tension, the wafer is moved relative to the diamond scribe in the X-direction to scribe the wafer in a line directly above the elongated sharp edge of the impulse bar. At the completion of a single scribing step, as described, the impulse bar and scribing tool retract from the wafer surface, the wafer is stepped a predetermined distance in the Y-direction, and the foregoing operation is repeated to draw a second scribe line in the X-direction separated from the first scribe line by a programmed Y-distance. This process is then repeated until all desired scribing has been completed in the first direction.

The annular wafer chuck (theta table) is then rotated 90° and the process repeated to scribe the wafer along lines perpendicular to the first set of scribes.

Once scribing has been completed, the X-table moves the impulse bar and wafer chuck along the X-axis to the breaking station beneath the anvil. In this position the anvil is moved to a predetermined distance above the wafer, and the Y-table moves the wafer in the Y-direction to position its first scribe line above the sharp edge of the impulse bar and beneath the anvil. Once so positioned, the impulse bar is forced upwardly to pinch the wafer scribe line between the anvil and the sharp edge of the impulse bar, thereby breaking the wafer along that scribe line. Once the break has been completed, the impulse bar is retracted and the wafer chuck moved a programmed Y-distance to bring the next adjacent scribe line into alignment with the sharp edge of the impulse bar. Once aligned, the impulse bar is again driven upwardly against the bottom of the wafer to break the wafer along said second scribe line. This process is repeated until all second direction scribe lines have been broken. The theta table then rotates the chuck 90 degrees and the same process is repeated to break all scribe lines perpendicular to the scribe lines first broken.

All of the foregoing movements are driven by individual motors under control of an 8051 microprocessor based computer system whereby the foregoing operations can be carried out with great precision and without operator intervention. For example, the scribe module includes an electric motor consisting of a linear voice coil actuator and position sensor which moves the diamond-tipped scribing tool of the module in a linear direction under motor control toward and away from the wafer surface. In addition, a load cell is inserted between the voice coil actuator shaft and the diamond-tipped cutting tool. Thus, both the position of and force applied by the diamond-tipped cutting tool relative to the wafer surface can be determined, encoded and thereafter controlled with great precision.

Alignments of the wafer position vis-a-vis the scribing and breaking apparatus are carried out by means of an 80386 microprocessor-based computer system which includes a color video camera, video image control circuitry, and a video monitor. All misalignments visually detected on the monitor can be manually corrected by the operator or automatically corrected by the 80386 computer using pattern recognition software techniques.

In an alternate embodiment, to avoid contact with the upper (integrated circuit bearing) surface of the wafer during the breaking process, the anvil above the wafer is eliminated and replaced with a supplemental wafer-holding chuck beneath the wafer surface. This supplemental chuck applies a vacuum to the wafer in the region surrounding the scribing line to be broken, i.e., in the region surrounding the point of impact of the impulse bar against the lower surface of the wafer. This restrains upward movement of the wafer during the breaking operation, without contacting the upper surface of the wafer. This embodiment is particularly suited for highly sensitive devices such as air bridges.

The operator has the option of operating the system in any one of four modes: 1) Set Up Mode, 2) Scribe Only, 3) Break Only, and 4) Scribe and Break.

During Setup Mode, the 8051 microprocessor control system is activated to determine and/or receive and store in memory data concerning the system's operating parameters including the following: dwell time, anvil height, wafer size, force applied to impulse bar, force to be applied to the wafer during scribing, gap between wafer impulse bar and anvil, wafer thickness, scribe extension, impulse bar height, scribe angle, scribe speed, edge approach speed and scribe type.

During Scribe Only Mode, all machine parameters are set automatically based on information stored in non-volatile RAM and the scribing operation is carried out automatically, as described above, without operator intervention.

In Break Only Mode, all machine parameters are set automatically based on information stored in non-volatile RAM and the breaking operation is carried out automatically, as described above, without operator intervention.

In Scribe and Break Mode, all necessary scribe and break parameters are set automatically based on information stored in non-volatile RAM and the scribing and breaking operations are carried out continuously, automatically, as described above, without operator intervention.

From the foregoing it will be seen that the present invention permits wafer scribing and breaking to be performed on the same wafer chuck, in a single piece of equipment.

Moreover, the equipment is under computer control so that the scribing and breaking functions are automated. Indeed, all scribing and breaking parameters are fully programmable including the positioning of the diamond cutting tool, so that a wafer may be fully processed (i.e. scribed and broken) without operator intervention. This fully programmable capability makes the machine particularly suited for automated cassette wafer loading. It also facilitates ISO 9000 certification.

Because the angle of the diamond cutting tool is controlled with a motor, even the angle of the diamond cutting tool may be programmed into memory and controlled by the microprocessor. This is particularly useful in that it eliminates the need for operator adjustments to the scribing/breaking controls, including tedious mechanical machine adjustments, when changing between wafer types.

Because the force of the diamond scribe tool is motor controlled, this permits the tool force to be programmed into memory and controlled by a microprocessor.

Moreover, because the scribe tool force is controlled by a voice coil, the scribe force is independent of diamond position. In other words, the voice coil produces a force which balances the force created on the scribe tool mechanism by gravity; thus the programmed scribe force takes even this gravitational force element into account. In the embodiment in which a load cell is located between the scribe tool and voice coil, the load cell can be used to monitor the scribe force.

The scribe tool itself is used to monitor the position of the scribe relative to the wafer. The diamond tool is positioned with a displacement sensor to detect the edge of the wafer. Once the wafer edge is detected, the scribe control is changed from a position loop to a force loop.

Because the scribe tool is mounted within the shaft of a linear bearing, this eliminates changes in the angle of the diamond tool with changes in diamond tool height i.e. with changes in wafer thickness.

During scribing, the wafer is supported directly below the scribe tool by the sharp edged impulse bar. This places the top surface of the wafer under tension during scribing, resulting in a thinner, finer scribe line. This tension can be varied by changing the height position of the impulse bar.

The scribe assembly, video camera and anvil assembly are located on a line perpendicular to the indexing of the wafer; and the camera lens is located between the scribe module and anvil break mechanism. This arrangement minimizes travel of the table in the X direction; allows the operator to view the scribe point as scribing occurs; and, during setup, allows precise alignment of wafer-to-scribe by using a video camera to identify and view the precise point on the wafer where the scribe point will be applied during scribing. A cross-hair is generated on the video screen to allow for alignment of the scribe and wafer "street".

To correct for the fact that the diamond tool cutting edge and impulse bar edge are always offset (i.e. never perfectly aligned in the same plane), the software learns the offset and then uses that information to correct the offset by making an adjustment to the Y position of the wafer during breaking. In this way, the impulse bar always strikes directly beneath the scribe, even though the diamond tool may not actually be aligned with the impulse bar.

The machine of the present invention permits the actual precise angle of the cutting edge of the cutting tool to be programmed into the memory. Thus, the scribe tool angle can be computer adjusted to compensate for variations in cutting edge angles from tool to tool, to provide consistent scribing from tool to tool.

The machine has a counter which records the distance the cutting tool has scribed. This allows the operator to know when a cutting tool has reached the end of its predetermined useful life, so that it may be re-set, re-sharpened or replaced. Because the system of the present invention distinguishes between edge approach and actual scribing, it provides a more accurate reading of aggregate distance scribed by a particular cutting tool than systems which record merely aggregate X distance travelled.

Scribes can be started on or off the wafer with equal result, since the diamond does not begin scribing until the tool senses it is on the surface of the wafer.

Since the wafer moves along the X (scribing) axis under motor control, the system can control the speed of the motor and, in turn, the speed of scribing. It can also position the diamond at any position and perform edge scribes and skip scribes of known distances.

With edge detection and control of the X axis, the wafer can be profiled and its dimensions determined, thereby eliminating time wasted while the diamond tool approaches the wafer. The scribe can be started at the edge of the wafer.

With edge detection, the system can perform edge scribes of exact length. It can also perform skip scribing on the surface of the wafer, as well as standard continuous scribing.

The 80386 microprocessor based computer, with video imaging capability, gives the system the ability to digitize and display a digitized image of the wafer on the video monitor. This wafer image can then be superimposed with computer-generated cross-hairs or other visual frame of reference. This, in turn, permits the operator to make a test scribe on the wafer, observe a digitized image of that scribe on the screen, superimpose the cross-hairs on the test scribe, and record the location of those cross-hairs in memory. Before making an additional scribe, the location of the cross-hairs is superimposed on the line or path desired to be scribed, thereby assuring that the next scribes will be made precisely on the line desired. This may be accomplished by an operator setting the Y-position while viewing the wafer and cross-hairs on the monitor; or it may be accomplished automatically by the computer with conventional pattern recognition techniques.

Compared to saw scribing, the scribing/breaking method and apparatus of the present invention tends to improve wafer yields. Wafers can be processed faster than with other devices, with less chipping and residual stress. Street widths are reduced, permitting increased wafer density. The toxic waste problems associated with arsenic contaminated water discharge from sawing operations are avoided.

The alternate embodiment of the present invention which employs a supplemental vacuum chuck positioned beneath the wafer surface, to replace the anvil above the wafer surface, permits wafer breaking without contacting the top wafer surface.

DESCRIPTION OF THE PREFERRED EMBODIMENT

At the outset, it should be understood that many structural details of the breaking apparatus of the present invention, particularly with regard to X,Y and theta tables, impulse bar, anvil, and wafer chuck assemblies are the same and/or similar to that shown and described in commonly assigned U.S. Pat. No. 4,653,680 to Barrie Regan, "Apparatus For Breaking Semiconductor Wafers And The Like", the disclosure of which is incorporated herein by this reference. The present invention inter alia adds scriber capability to the Regan breaker apparatus, and motorizes and computerizes the scribing and breaking operations so that, if desired, the machine can accomplish both scribing and breaking on the same apparatus without operator intervention.

Figure 1:
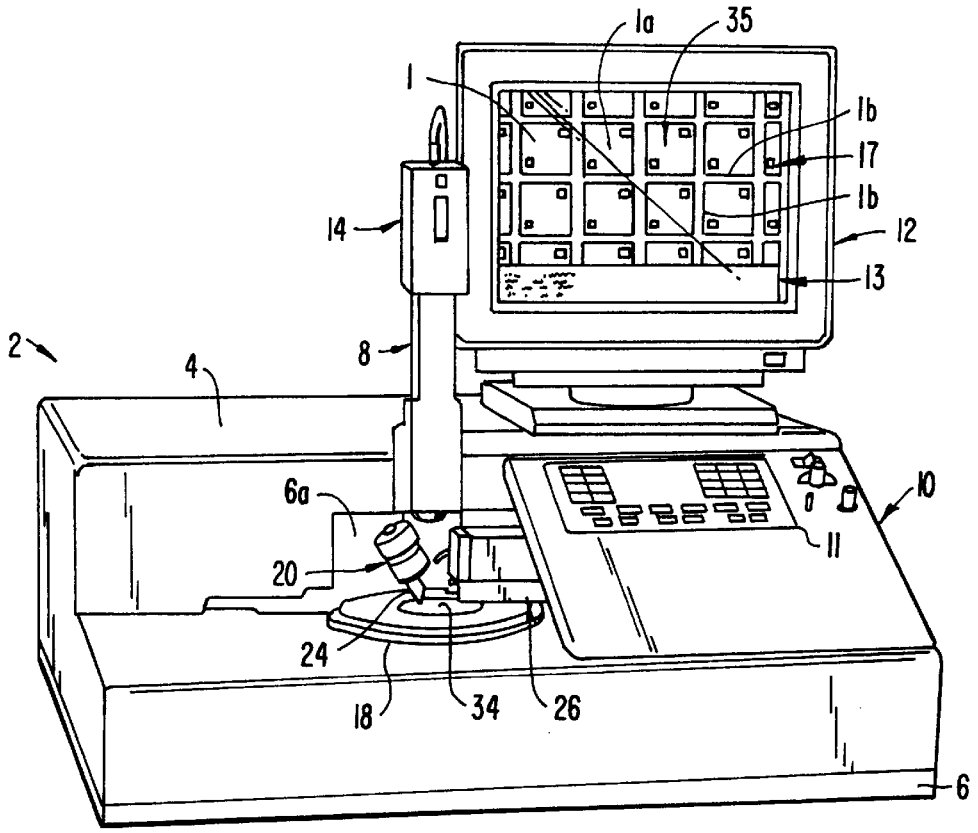
FIG. 1 is a frontal elevation in perspective of a scriber/breaker apparatus constructed in accordance with the present invention.
Figure 2:
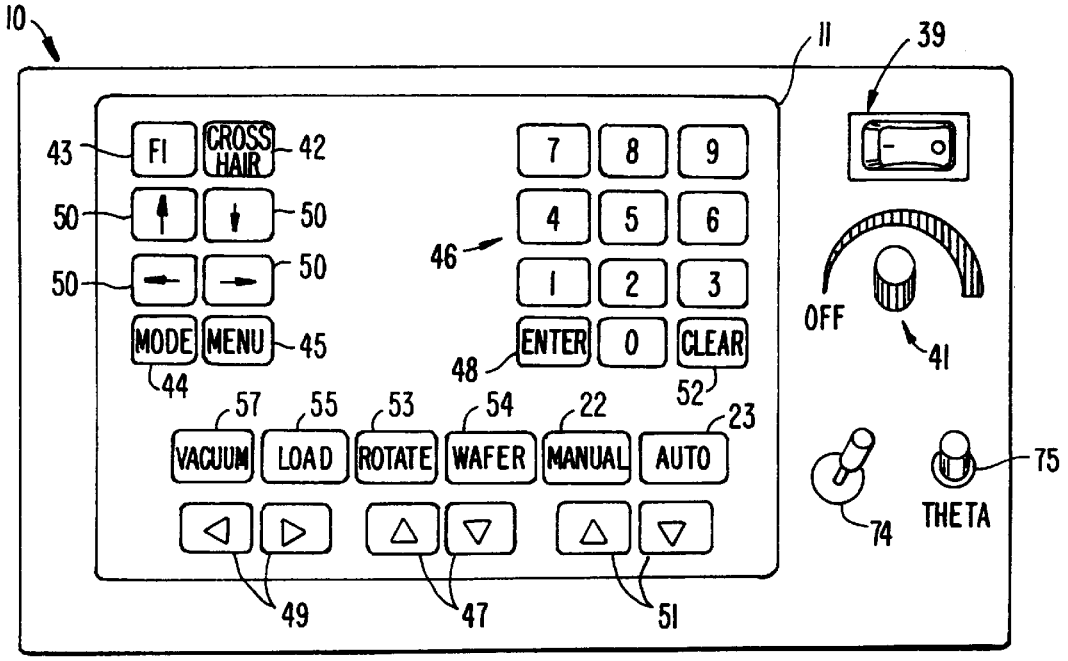
FIG. 2 is a plan view of the control panel of the scriber/breaker apparatus of FIG. 1.

Referring now to the drawings, a first embodiment of the mechanical apparatus 2 of the scriber-breaker system of the present invention is depicted in FIGS. 1–10. Viewed externally, as in FIG. 1, the scriber-breaker apparatus 2 is supported on a base (chassis) unit 6 covered by an external casing 4. The wafer 34 to be scribed and/or broken is supported upon a vacuum wafer-holding chuck 18 located on the front upper surface of the apparatus 2. A wafer scribe module 20 is mounted directly above the wafer 34. The scribe module 20 includes a diamond-tipped cutting tool ("scribe") 24 extending downwardly toward the wafer surface in the "scribe ready" position, i.e., at a five o'clock angle. A color video camera 14 is mounted above the scribe module 20 on a vertical arm 8, with the camera 14 focused downwardly on the upper surface of the wafer 34. A breaker anvil assembly 26 is positioned to the right-hand side of the scribe module 20. An electronics control panel 10, having a keypad 11, is located to the right of the scribe/wafer/anvil region. A color video monitor 12 rests on the upper rear surface of the casing 4. The screen of the monitor 12 has a menu bar 13 extending across its bottom edge. The upper region 17 of the monitor screen displays a magnified digitized image 35 of the wafer 34, as viewed by the camera 14. As can be seen from the magnified wafer image 35, the wafer includes a number of rectangular integrated circuit devices 1*a* arranged in rows and columns, separated by narrow vertical and horizontal pathways or "streets" 1*b*. Included in the overall system, but not shown in FIG. 1, is a freestanding 80386 microprocessor-based computer system which digitizes the video camera image of the wafer and displays that image on the monitor 12. The 80386 computer system includes a floppy disk and keyboard or other comparable storage and input devices.

Figure 17:
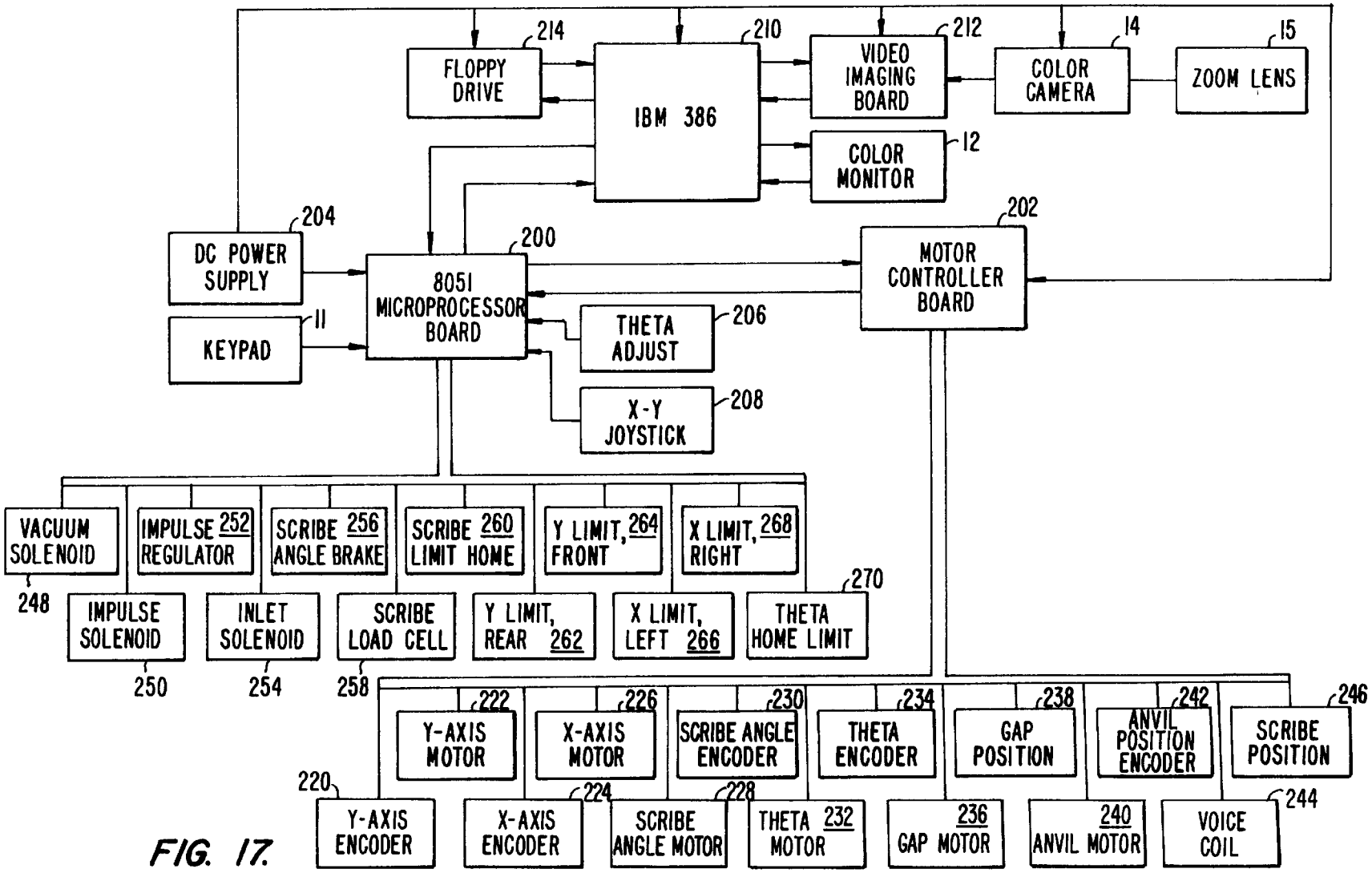
FIG. 17 is a schematic block diagram of the electronic control system for all components of the scriber-breaker system of the present invention.

Included is 8051 system and components as detailed in FIG. 17.

Figure 3A:
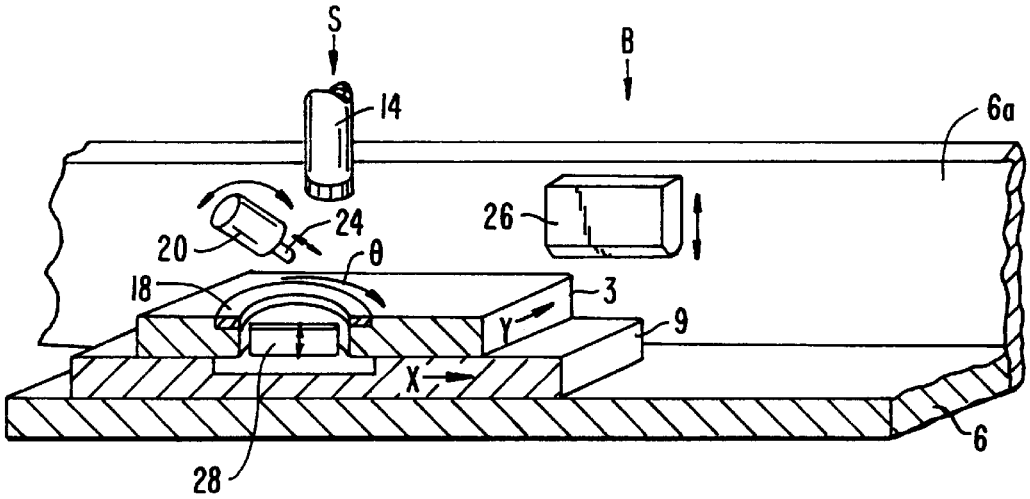
FIG. 3A is a schematic diagram of the apparatus shown in FIGS. 1–8 with the base, X-table, Y-table, wafer chuck, impulse bar, scribe module, camera and anvil when the wafer chuck is at the Scribe Station.
Figure 3B:
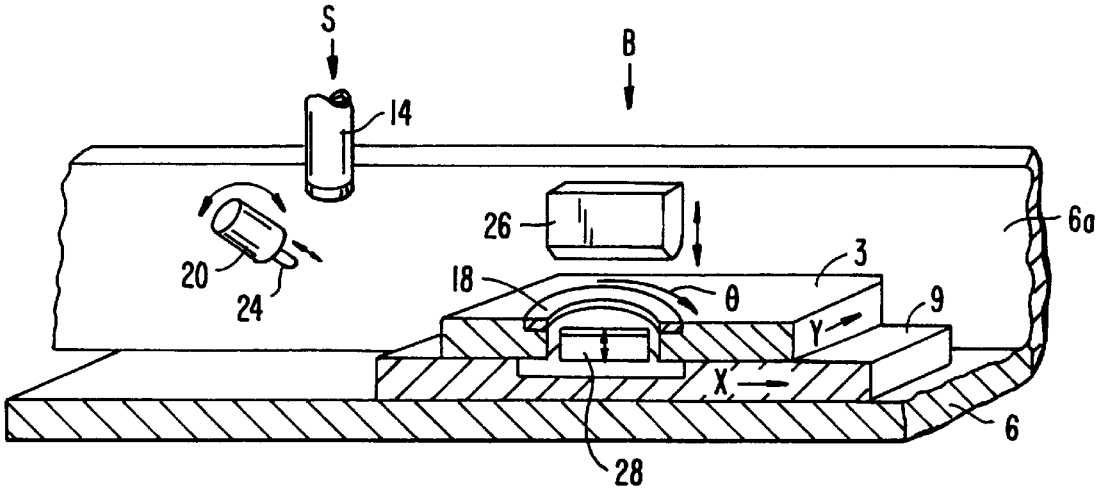
FIG. 3B is a schematic diagram of the apparatus of FIG. 3A with the wafer chuck at the Break Station.

FIGS. 3A and 3B provide a brief overview of the main mechanical elements of the scriber breaker apparatus 2, and their operation. FIG. 3A shows the apparatus 2 with the wafer chuck 18 located at the scriber station "S", i.e. beneath the scriber module 20 and video camera 14. It can be seen that the base 6 is stationary. The X-table 9 is mounted on the base for right-left (X) movement. The Y-table 3 is mounted on the X-table 9 for front-back (Y) movement. The wafer chuck 18 (also sometimes called the "theta table") is mounted on the Y-table 3 for rotational movement in the Θ direction. The scribe module 20, camera 14 and anvil 26 are all mounted on the rear frame 6*a*. The scribe module 20 can rotate about an axis perpendicular to the surface of rear frame 6*a*, and its diamond cutting tool 24 moves in and out linearly in whatever direction the module 20 is pointed. The camera 14 is fixedly mounted to focus on any wafer held by the wafer chuck 18 while located at the scribe station S. While the chuck 18 is at scribe station S, the anvil 26 remains at the break station B, so it does not interfere with scribing operations.

FIG. 3B shows the apparatus 2 after X-table 9 has transported the wafer chuck 34 and impulse bar 28 from the scribe station S to the break station B. Now the wafer chuck 18 and impulse bar 28 are aligned beneath the anvil 26, for breaking operations. In this configuration, the scribe module 20 and camera 14 remain at the scribe station S and are not involved in the breaking operation. By comparison, impulse bar 28 is involved in both breaking and scribing, and is therefore carried back and forth between scribe and break stations S and B by the X-table.

Having provided a general overview of the functional mechanical parts of the scribing and breaking apparatus, the following provides detailed discussion of same with reference to FIGS. 4 to 11.

Figure 4:
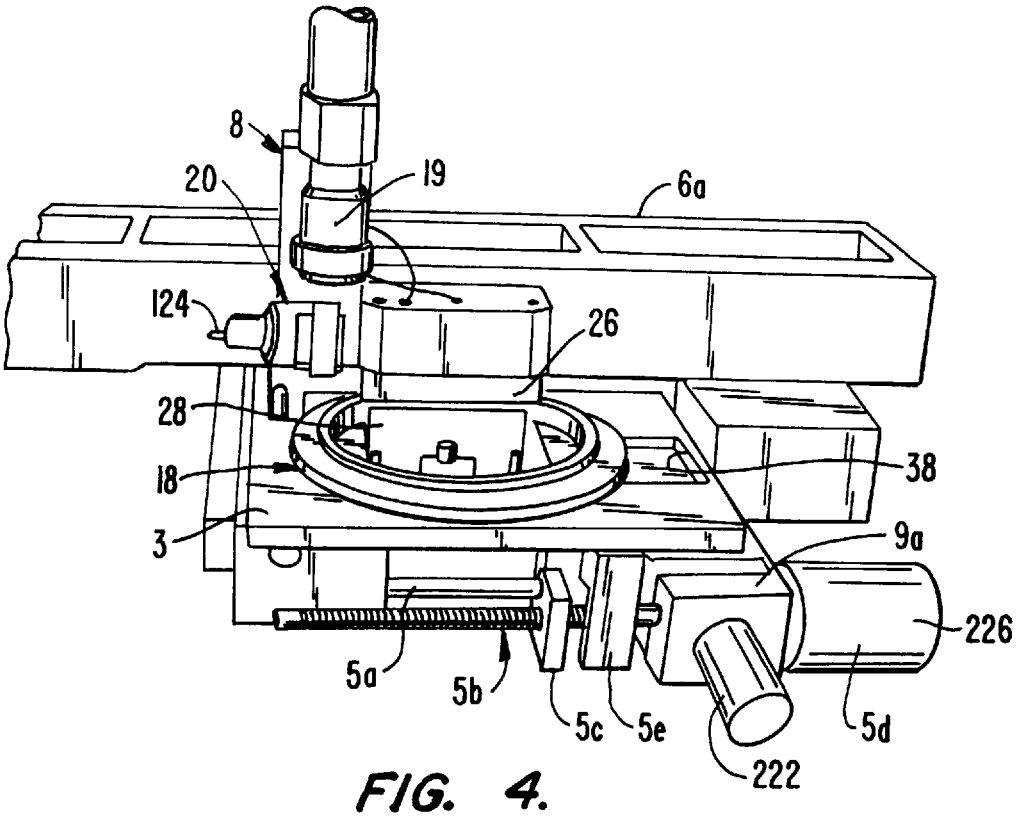
FIG. 4 is a frontal elevation in perspective of the scriber/breaker apparatus of FIG. 1, with certain parts broken away and removed, to illustrate the relationship of the scribe module, anvil, impulse bar and wafer chuck while the apparatus is in the break position.
Figure 5:
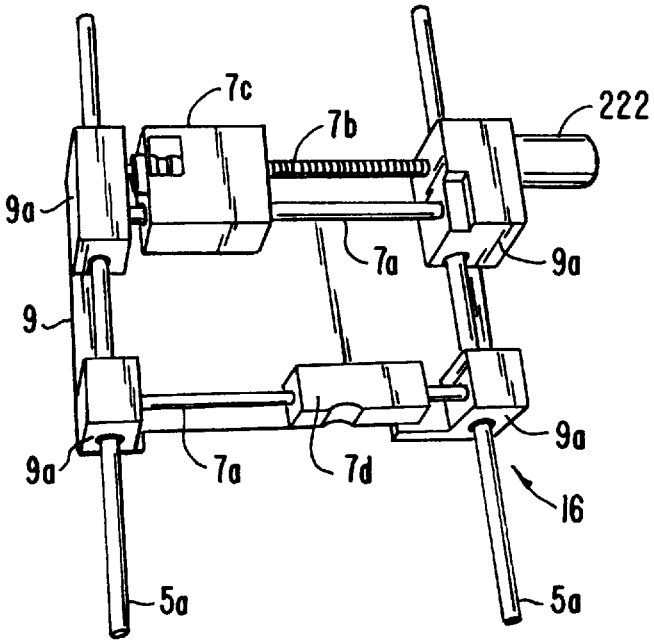
FIG. 5 is a perspective view from above of the X-table and its X-Y mounting bearings corresponding to the apparatus shown in FIGS. 1–4.

As shown in FIG. 4, the apparatus 2 includes a base unit 6 (corresponding to the frame 10 in the Regan '680 patent). This base supports the X-table 9 shown in FIG. 5. The X-table 9 supports four mounting bearings 9*a*, one at each corner of the X-table 9. A parallel pair of spaced guiderails 5*a* support the X-table 9. Each end of each guiderail 5*a* is fixedly attached to vertical legs extending upwardly from the base unit 6 (similar to the corresponding mounting in Regan's patent, where the ends of guide rods 12 are mounted in the vertical end walls of base unit 10, as best shown in Regan FIGS. 1 and 5). Thus, the X-table 9 slides in the right-left or X-direction on mounting bearings 9*a*, and is driven back and forth in that X-direction by the motorized X-screw assembly system 5 consisting of X-lead screw 5*b*, motor 5*d* and nut 5*c*. Nut 5*c* rotates on X-lead screw 5*b* when driven in the X-direction by rotation of X-lead screw 5*b* by X-axis motor 226. The drive shaft of X-axis motor 226 is coaxially linked to X-lead screw 5*b* and supported by the right-hand side frontmost mounting bearing 9*a*. The nut 5*c* is connected by vibration isolation devices 5*f* to X-bearing block 5*e* which is in turn mounted to the X-table 9 beneath.

The Y-table 3 is mounted on the X-table assembly system 16 and is driven back and forth in the Y-direction by motorized Y-screw assembly system 7 consisting of guiderails 7*a*, Y-lead screw 7*b* and Y-bearing block 7*c*. Y-control spaced Y-oriented guiderails 7*a* extend in the Y-direction, perpendicular to X-oriented guiderails 5*a*, through the four mounting bearings 9*a* located at the four corners of the X-table 9. In addition, the Y-table 3 is provided with a motorized lead screw assembly consisting of Y-lead screw 7*b*, Y-bearing block 7*c*. One end of the Y-lead screw 7*b* locates in the Y-bearing block 7*c* and the other end locates in the rightmost front mounting bearing 9*a* where it is coaxially linked to the Y-axis motor 222. The Y-table 3 is further supported on guiderail 7*a* opposite Y-lead screw 7*b* by Y-bearing block 7*d*.

Wafer-holding chuck 18 is mounted on Y-table 3 for rotational movement about an axis perpendicular to the surface of Y-table 3. As shown in FIG. 4, wafer chuck 18 is, in essence, an annular ring which rests in a shallow depression 38 in the Y-table 3. The radially outer surface of that portion of wafer chuck 18 which rests in the depression 38 has external radial gears which mesh with a corresponding circular gear located in depression 38 and driven in rotation by theta motor 232. Thus, the wafer chuck 18 may be driven in an angular (theta) direction by the said theta motor 232 through an angle of at least ninety degrees so that a wafer 34 carried on said chuck 18 can itself be rotated through a ninety degree arc when desired. Thus, it will be seen that the wafer chuck 18 can be moved not only in rotation, but also right to left in the X-direction under movement of the X-table and from front to back during movement of the Y-table.

Figure 6:
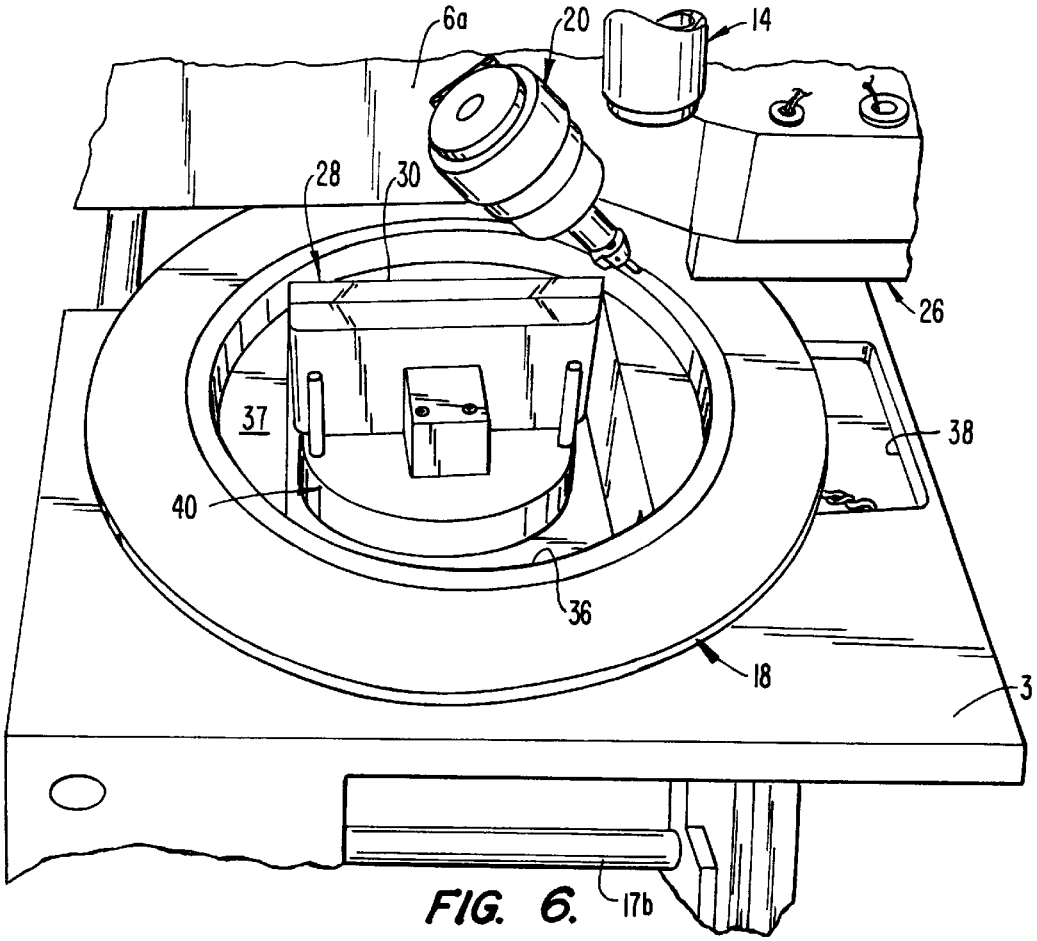
FIG. 6 is an enlarged perspective view of the vacuum wafer chuck, scribe module, impulse bar and anvil of the apparatus shown in FIG. 1, when those components are in the scribe position, with the scribe module set at the five o'clock position. This view does not include a wafer so that the impulse bar assembly can be clearly seen.
Figure 7:
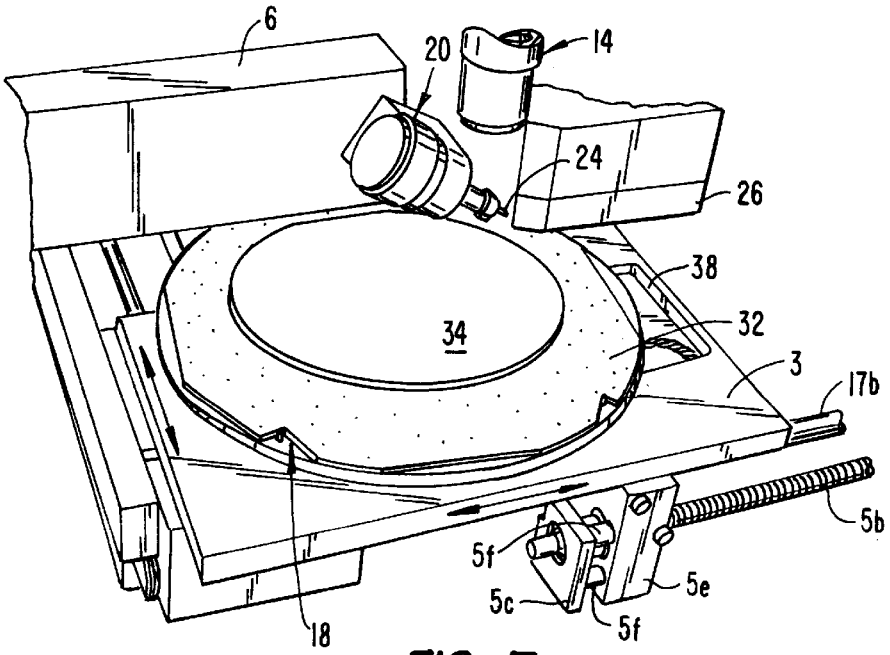
FIG. 7 shows the apparatus of FIG. 6 with a wafer in place on the vacuum chuck.

As best shown in FIG. 6, an impulse bar support assembly 40 is supported on X-table 9 beneath the annular opening of wafer chuck 18. When a wafer 34 is placed across the annular opening of wafer chuck 18 and a vacuum applied, the wafer is drawn down against and secured to the wafer chuck 18. The impulse bar support assembly includes the impulse bar itself 28 and the impulse bar motor referred to as the gap motor 236 on FIG. 17, and position sensor, referred to as gap position 238 on FIG. 17. The upper edge of the impulse bar 28 is a straight sharp blade 30. The impulse bar motor 236 is movable between up and down positions. In its down position, the sharp edge 30 of the bar 28 is in its lowermost position, furthest from the wafer 34. In its "up" position, the sharp edge 30 of impulse bar 28 extends above the upper surface of the plane of the annular wafer chuck 18 opening so that, when a wafer 34 is in place, the sharp edge 30 of the impulse bar 28 forces against the bottom surface of the wafer bending the wafer upwardly and placing the upper surface of the wafer under tension along a line opposite the sharp edge 30. Thus, it will be seen that by means of rotating the theta table 18 the wafer may be rotated through an arc of ninety degrees relative to the sharp edge 30 of impulse bar 28. Moreover, because the impulse bar is mounted on the X-table, whereas the theta table (and wafer) are mounted on the Y-table, the wafer may be moved in the Y-direction relative to the impulse bar by moving the Y-table in the Y-direction.

The anvil 26 is mounted to the vertical section 6*a* of the frame 6. Anvil 26 extends generally along the X-axis at a vertical location above the plane of the upper surface of the wafer 34. When the X-table has been shifted to the Breaking Station B, the impulse bar 28 is located directly beneath the anvil 26, with the sharp edge 30 of the impulse bar 28 aligned with the elongate axis of the anvil. The height of the anvil can be adjusted by means of a lead screw driven stage with anvil servo motor 240 and linear displacement sensor (LVDT) 242 so that the height of the anvil 26 is adjustable to allow for different wafer thicknesses.

Figure 8:
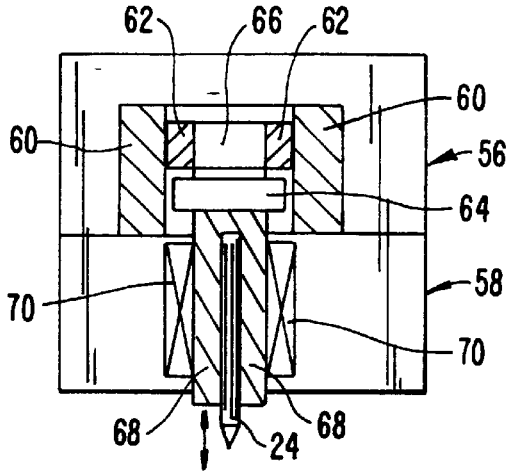
FIG. 8 is a schematic sectional diagram of the scribe module shown in FIG. 6, showing the relationship of the voice coil, load cell and diamond-tipped scribing tool in assembly. This diagram also shows a load cell mounted between the scriber an the voice coil, to measure scriber tool force directed to the wafer.

The scribe module 20 is mounted on the vertical portion of base unit 6. As best shown in FIG. 8, the scribe module 20 includes a voice coil portion 56 and a body portion 58. The voice coil 56 includes permanent magnets 60 surrounding electrical coils 62 disposed on a central shaft 66. Shaft 66 is designed for linear movement in response to electrical current in the coils. Actuator shaft 66 is coupled to tool support shaft 68 by means of a load cell 258. Tool support shaft 68 holds the diamond-tipped cutting tool 24. Tool support shaft 68 is supported for linear movement by opposed linear bearings 70. In operation, electrical current is sent through the coils 62 to cause movement of the scribe tool 24. The scribe module 20 is also mounted for rotational motion about an axis perpendicular to the support surface 6. Scribe module 20 rotation is controlled by scribe angle servo motor 228. Thus, scribe module 20 may be rotated to positions at nine o'clock, three o'clock and five o'clock under control of servo motor 228, as is required for the breaking, loading and scribing operations, respectively.

In operation, a sheet of flexible, expandable adhesive membrane 32 sometimes referred to as "nitto tape" is mounted on a hoop or steel frame. A semiconductor wafer 34 is mounted on the top surface of the tape 32. The taped wafer is then placed manually by the operator on the vacuum chuck 18, covering the central chuck opening 36.

Prior to processing wafers, the operator actuates the system's computer controls to store in memory, parameters for each wafer. Parameters for up to 16 or more wafers may be stored.

The system's operating parameters include the dwell time, i.e. the length of time that the impulse bar is in contact with the wafer; anvil height, i.e. the height of the anvil above a reference point equal to the upper plane of the vacuum chuck; wafer size, i.e. the diameter of the wafer; force to be applied to the wafer during scribing, i.e. the force to be applied to the wafer by the tip of the diamond-tipped cutting scribe 24 during scribing; the gap between the wafer impulse bar and anvil, i.e. the distance between the upper edge 20 of the impulse bar 28 and the lower edge of the anvil 26; wafer thickness, i.e. the distance between the top and bottom surface of the wafer; scribe extension, i.e. the distance which the voice coil actuator 56 has extended the tip of the cutting tool past a reference point equal to the top surface of the wafer 34 when mounted onto chuck 18; impulse bar height, i.e. the vertical height of the sharp edge 30 of the impulse bar 28 above the top surface of the vacuum chuck during scribing, also a measure of wafer tension; scribe angle, i.e. the angle which the longitudinal axis of the shank of the diamond-tipped cutting tool 24 makes upon intersection with the upper surface of the wafer 34 positioned on the vacuum chuck 18; scribe speed, i.e. the X-direction speed of the tip of the cutting tool 24 relative to the wafer surface during scribing; and edge approach speed, i.e. the speed with which the scribe 24 approaches the edge of the wafer 34 during the position loop, before the scribe loop.

Figure 9:
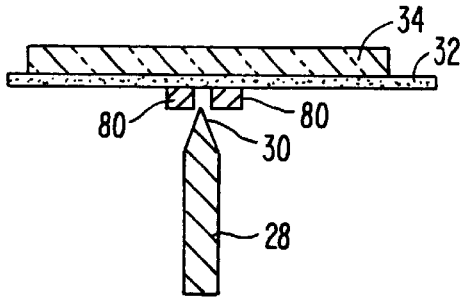
FIG. 9 is a schematic sectional elevation of the supplemental vacuum chuck used for breaking wafers in the "noncontact mode", i.e., with the anvil removed.

FIG. 9 illustrates an alternate embodiment in which the anvil 26 may be removed and replaced with a supplemental vacuum chuck 80 disposed against the bottom surface of the wafer 34. (As shown in FIG. 9, the bottom surface of the wafer is covered with flexible expandable adhesive nitto tape 32. It will be understood by persons of skill in the art that when reference is made herein to the impulse bar striking the bottom surface of the wafer that this includes the normal situation in which the bottom surface of the wafer is actually covered by a layer of nitto tape. In this respect, the term "wafer" is intended to include the tape, since it is used in all applications). The supplemental vacuum chuck 80 is applied to either side of the line where the sharp edge 30 of the impulse bar 28 strikes the bottom surface of the wafer 34 during wafer breaking. The said vacuum applied by the supplemental chuck 80 causes the wafer to resist upward movement resulting from force applied by the impulse bar accordingly. The scribed wafer 34 may be broken by force of the impulse bar 28 without employing an anvil in contact with the upper surface of the wafer 34. This non-contact breaking apparatus and method is particularly useful for breaking wafers with delicate integrated circuit components, such as air bridges. As will be appreciated from inspection of FIGS. 3A and 3B, the use of a non-contact breaking system of the type shown in FIG. 9 would eliminate the need for separate scribing and breaking stations, since, as shown in FIG. 3A, the scribing could occur at the scribing station; and because there is no anvil in this embodiment, there would be no need to move the X-table 9 to breaking station B. Supplemental vacuum chuck 80 could be activated at scribe station S after scribing has occurred, or even during scribing.

A. SETUP MODE

To enter Setup Mode, the operator presses the mode key 44 on the touchpad 11, until Setup Mode appears on the video monitor 12, as follows:

| |
|---|
| SETUP MODE<br>WAFER NAME<br>1. UNUSED00 |

1. Wafer Name Menu

The wafer can then be given a name of up to eight alphanumeric characters (although the number preceding the name cannot be changed) by scrolling through the programmed alphabet with scroll keys 50 and then pressing the enter key 48.

2. Units Menu

When enter key 48 is pressed, the numeric name of the subject wafer is saved and a new (UNITS) menu appears as follows:

| |
|---|
| SETUP WAFER01<br>SELECT UNITS<br>ENGLISH-MILS |

Four selections of units are English-mils; English-inches; Metric-microns; and Metric-millimeters. These four selection are available on the menu appearing on the monitor 12. The desired units may be selected by scrolling through these selection with the arrow keys 50, and pressing enter 48 when the cursor arrives at the units desired, which also causes the next (X STEP MENU) to appear.

3. X Step Menu

Using the X STEP MENU, the operator may enter wafer diameter dimensions for the first wafer selected for processing. The system can be programmed with multiple step sizes corresponding to a range of possible die sizes. To enter the dimensions of a wafer with step size 40, for example, the operator presses clear key 52, followed by numeric keys 4, 0 and 0 on the numeric keypad 46, then the enter key 48.

4. Y Step Menu

The Y STEP menu works the same as the X STEP menu. It is used to enter the die dimensions which will be processed second, e.g. the step size of the streets running perpendicular to the first set of streets scribed on wafer number one. A common step size for the second dimension is 20. To enter step size 20, the operator presses clear key 52, the 2, 0 and 0 keys 46, and then enter key 48, which saves step size 20 and causes the next (CYCLE TIME) menu to appear.

5. Cycle Time Menu

CYCLE TIME is the time between indexing of the table during breaking. Cycle time can be set to 00 seconds as a starting value, since the cycle time has no effect on the quality of the break. To accomplish this, the operator presses the clear key 52, which causes the following menu to be displayed:

| |
|---|
| SETUP WAFER 01<br>CYCLE TIME<br>CYCLE = 0.00 SECONDS |

The operator presses enter key 52, causing the next (DWELL TIME) menu to appear as follows:

SETUP WAFER 01
DWELL TIME
DWELL = 0.00 SECONDS

6. Dwell Time Menu

The DWELL TIME is the time that the impulse bar 28 is in contact with the wafer 34 while the impulse bar 28 is in the up position. The operator operators 0.20 as a starting value. Different starting values will affect the quality of the break. Experimentation is recommended to find the correct value for each wafer being processed. To enter 0.20 as a starting value, press 2, 0 on the numeric keypad 46.

7. Wafer Size Menu

Having entered Dwell Time 0.20 seconds, press enter key 48 to save 0.20 as a starting value and change to the next (WAFER SIZE) menu, as follows:

SETUP WAFER 01
WAFER SIZE
SIZE = 0.0 INCHES

The WAFER SIZE MENU is used to enter the size of the wafer if it is less than four inches. The machine will stop scribing or breaking after the wafer size value input by the operator has been reached. To enter the size for a four-inch wafer, press 4, 0 on the numeric keypad 46, whereupon the menu display will read as follows:

SETUP WAFER 01
WAFER SIZE
SIZE = 4.0 INCHES

Having entered 4.0 inches, press enter key 48 to save wafer size four inches and display the next (ANVIL HEIGHT) menu as follows:

SETUP WAFER 01
ANVIL HEIGHT
HEIGHT = 00 MILS

8. Anvil Height Menu

ANVIL HEIGHT is the height of the anvil 26 above the upper surface of the vacuum chuck 18 in BREAK MODE. ANVIL HEIGHT is a critical parameter for breaking quality. Normal anvil height is the sum of the wafer thickness, top mylar and nitto tape thickness plus one mil of clearance. If mylar is not used, then the mylar thickness should be subtracted from the following calculations: Example:

| Anvil Height Calculation | |
|---|---|
| Wafer Thickness: | 17 mils. |
| Tape Thickness: | 3 mils |
| Clearance | 1 mil |
| ANVIL HEIGHT | 21 mils |

Having calculated the anvil height, the operator presses 2, 1 on the numeric keypad 46, whereupon the following display appears on the monitor menu:

SETUP WAFER 01
ANVIL HEIGHT
HEIGHT = 21 MILS

To save the anvil height calculation of 21 mils, the operator presses the enter key, and the system displays the next (IMPULSE BAR GAP) menu as follows.

9. Impulse Bar Gap Menu

The IMPULSE BAR GAP MENU is as follows:

SETUP WAFER 01
GAP
GAP = 18 MILS

The impulse bar gap is the distance between the bottom edge of the anvil 26 and the top (sharp) edge 30 of impulse bar 28 when the impulse bar 28 is in the up (extended) position for breaking a wafer. Decreasing the impulse bar gap will increase the breaking force. The standard setting for the impulse bar gap is two mils less than the anvil height.

A sample gap calculation might be as follows:

| GAP CALCULATION | |
|---|---|
| ANVIL HEIGHT | 21 mils |
| less 2 mils | −2 mils |
| GAP SETTING | 19 mils |

To enter a calculated gap setting of 19 mils, the operator presses 1, 9 on the numeric keypad 46, whereupon the monitor will display the following message:

SETUP WAFER 01
GAP
GAP = 19 MILS

The operator then saves the 19 mils gap by pressing enter, whereupon the monitor will display the next (IMPULSE BAR FORCE) menu:

10. Impulse Bar Force Menu

The IMPULSE BAR FORCE MENU is as follows:

SETUP WAFER 01
IMPULSE FORCE
PRESSURE = 00 PSI

The impulse bar force is the pressure that is exerted on the diaphragm that drives the impulse bar. This is always set in pounds per square inch (PSI), regardless of units chosen.

Increasing the pressure will increase the breaking force.

Eight PSI is a common starting point for wafers less than 15 mils in thickness; and 10 PSI for wafers greater than 15 mils.

To enter a pressure of 8 PSI, the operator presses 8 on the numeric keypad 46, whereupon the following message appears on the monitor:

SETUP WAFER 01
IMPULSE FORCE
PRESSURE = 08 PSI

The operator saves an impulse bar force of 8 PSI by pressing the enter key 48, whereupon the wafer thickness menu is displayed.

11. Wafer Thickness Menu

The WAFER THICKNESS menu is as follows:

WAFER THICKNESS
THICKNESS = 00.0 MILS

To enter a wafer thickness of 15 mils, press 1, 5 on the numeric keypad 46, followed by the enter key 48.

12. Scribe Extension Menu

SCRIBE EXTENSION is the vertical distance that the scribe tip is extended below the upper surface of the wafer while approaching the wafer when scribing. A common starting value is two mils. To enter a scribe extension of two mils, the operator presses 2 on the numeric keypad 46, whereupon the following message will appear on the monitor 12:

SCRIBE EXTENSION
EXTENSION: 2.0 MILS

The operator saves 2 mils as scribe extension by pressing the enter key 48, which also causes the next (IMPULSE BAR HEIGHT) menu to be displayed.

13. Impulse Bar Height

The IMPULSE BAR HEIGHT menu is as follows:

IMPULSE BAR HEIGHT
HEIGHT 0.0 MILS

During scribing, the impulse bar 28 is raised so that its upper edge 30 supports the wafer beneath the scribe 24. Varying the height of the impulse bar varies tension on the wafer 34. The IMPULSE BAR HEIGHT menu is used to program the height of the sharp edge 30 of the impulse bar 28 above the upper surface of the vacuum wafer holding chuck 18 during scribing. A value of 0 leaves the top edge of the impulse bar even with the vacuum chuck top surface. A common starting height is 2 mils.

14. Scribe Type Menu

This menu is for choosing the scribe type, of which there are three choices: (1) Continuous Scribe, wherein the entire length of wafer is scribed; (2) Edge Scribe, wherein the scribe commences at one edge of the wafer and continues for a set distance; and (3) Skip Scribe, wherein the scribe is a set distance for each die on the wafer. As with the UNITS MENU, the SCRIBE TYPE MENU operates on a scroll basis using the arrow keys 50 to toggle among the three scribe choices. Pushing the enter key 48 activates the choice.

If Continuous Scribe is chosen, the screen message is as follows:

SCRIBE TYPE
TYPE: CONTINUOUS

For Edge Scribing, the distance of the scribe is determined from the edge of the wafer. The machine senses the edge of the wafer and scribes the programmed distance. When the edge scribe choice is selected, the screen message is as follows:

SCRIBE TYPE
TYPE: EDGE
LENGTH: 00 MILS

The desired length of scribe is entered with the numeric keypad 46.

Skip scribing uses the data programmed for X and Y step to determine the distance to skip. The desired length of the scribe is entered into the program with the numeric keypad 46, followed by the enter button 48. The screen message for skip scribing is as follows:

SCRIBE TYPE
TYPE: SKIP
LENGTH: 00 MILS

15. Scribe Speed Menu

Scribe speed is the speed that the X table 16 moves while scribing. A common value for GaAS wafers is 500 mils per second. Higher speeds tend to detract from scribe quality. The scribe speed menu display is as follows:

SCRIBE SPEED
SPEED: 0500 MIL/S

The speed the wafer 34 moves prior to being contacted by the diamond cutting tool 24 is slower than the scribe speed in order to prevent damage to the wafer. Once the diamond 24 is on the surface of the wafer 34, the wafer 34 is accelerated to the programmed scribe speed.

16. Scribe Approach Speed

Scribe approach speed is the speed that the diamond 24 approaches the edge of the wafer 34. Higher speeds will reduce cycle time but also tend to cause damage where the scribe tool 24 contacts the edge of the wafer 34. The speed may be varied depending on the type of wafer material being scribed. The scribe approach speed menu displayed on the monitor 12 is as follows:

SCRIBE APPROACH SPEED
SPEED: 000 MILS/S

17. Scribe Force

Scribe force is the force exerted by the diamond 24 on the wafer 34. Scribe force is independent of scribe position. Scribe force is programmed in values from 1650 to 1800. A common starting value is 1650. Scribe force may need to be adjusted for different scribe speeds, scribe angles and wafer surface conditions.

The scribe force menu displayed on the monitor is as follows:

SCRIBE FORCE
FORCE: 1650

18. Scribe Angle Menu

The scribe angle menu is used to program the desired scribe angle. Scribe angle is preferably limited to between 32 and 38 degrees from vertical. The scribe angle is set by the DC servo motor and is preferably accurate to 0.1 degrees.

Angles between 32 and 35 degrees are for toe scribes. Angles between 35 and 38 are for heel scribes. For both heel and toe scribes, angles close to 35 degrees yield the narrowest scribes. Larger angle variations from 35 degrees will yield coarser scribes and are useful for wafer materials which are difficult to fracture. A common toe scribe angle is 34 degrees. A common heel scribe angle is 36 degrees. Heel scribing is generally used on III–V materials.

The scribe angle menu displayed on video monitor 12 is as follows:

SCRIBE ANGLE
ANGLE: 36.0 DEG.

Having completed setup of each of the foregoing 18 steps/menus, the first wafer has now been fully programmed. Additional wafers may be programmed into the machine by following each of the foregoing 18 setup steps for each wafer.

B. SCRIBE ONLY MODE

Scribing in SCRIBE ONLY mode can be done either manually or automatically. In MANUAL mode, the current "street" of the wafer is scribed from the current X position, but the water is not indexed. Thus, after scribing, the wafer is returned to starting position. In AUTO MODE, the wafer is scribed and indexed from the current street. Thus, scribing continues until AUTO is pushed again or the programmed wafer size is exceeded.

To scribe a wafer in SCRIBE ONLY mode, press the MODE KEY 44 until the first scribe mode menu appears as follows:

SCRIBE MODE
WAFER: 1. WAFER 01
TYPE: CONTINUOUS
F: 1650 A: 29.5 S: 0500.

This indicates that the system is in SCRIBE MODE and is prepared to operate on wafer No. 1, named "Wafer 01"; that the scribe type will be continuous; that scribe force will be 1650 psi; that the scribe angle will be 29.5°; and that the scribe traverse speed will be 0500 in programmed units. Press the WAFER key 54 until the desired wafer name appears and then press the ENTER key 48 to activate the chosen wafer, i.e., to set the scribe parameters of the chosen wafer. The following message will display while the scribe parameters are being set:

PLEASE WAIT
POSITIONING ANVIL
AND IMPULSE BAR

After scribing parameters are set, the scribe module 20 will rotate to the programmed angle. When positioning is complete, the second scribe menu displays the wafer name, X step, number of scribes, table position, table direction and vacuum status, as follows:

SCRIBE 1. WAFER 01
X STEP: 0040.0 MILS
BRK: 000 POS: 0.0000
DIR: IN VAC: OFF

This second break menu indicates that for wafer 1, named "Wafer 01", the X step size is 0040.0 mils; the number of breaks performed so far are 0; the table position is 0; the table direction is "in" and the vacuum is turned off.

1. Scribe Only Process, Main Program

Figure 10B:
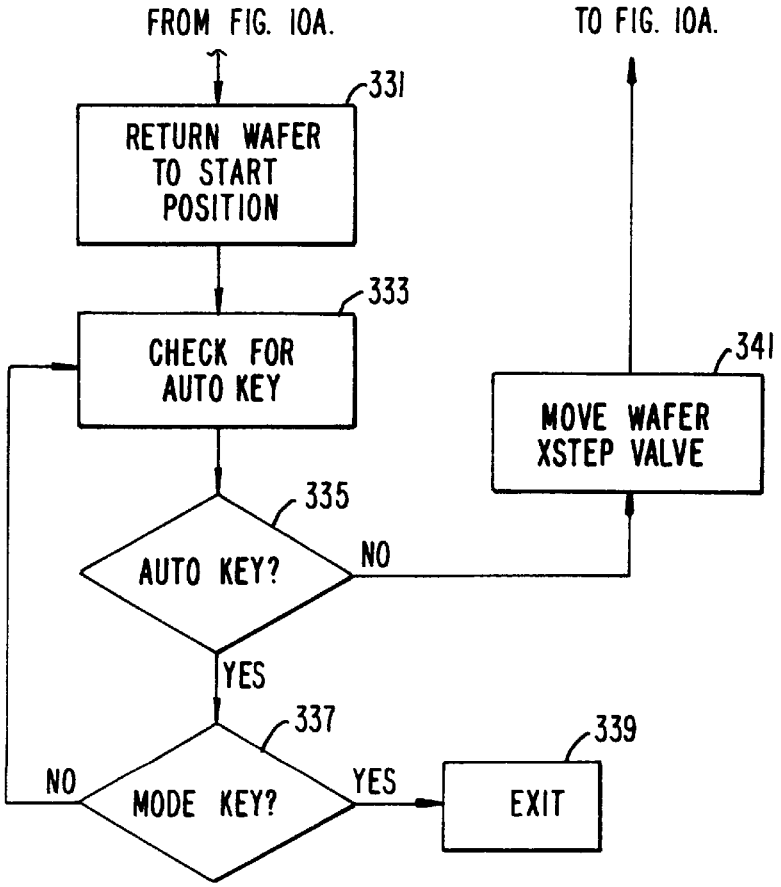
FIG. 10B is a continuation of FIG. 10A.

The process of scribing the wafer will now be described with respect to FIGS. 10A and 10B of the drawings. Scribe mode is selected by means of the mode key 44 of the touchpad 11 (300). When scribe mode appears on the menu, the scribe parameters are set by pressing enter key 48 (302). Anvil position is then set (304) with anvil position sensor 242, and anvil motor 240. Anvil 26 is out of the way and does not interfere with scribing operations (304). The system calls up the impulse bar position subroutine 306.

a. Impulse Bar Subroutine

Figure 13:
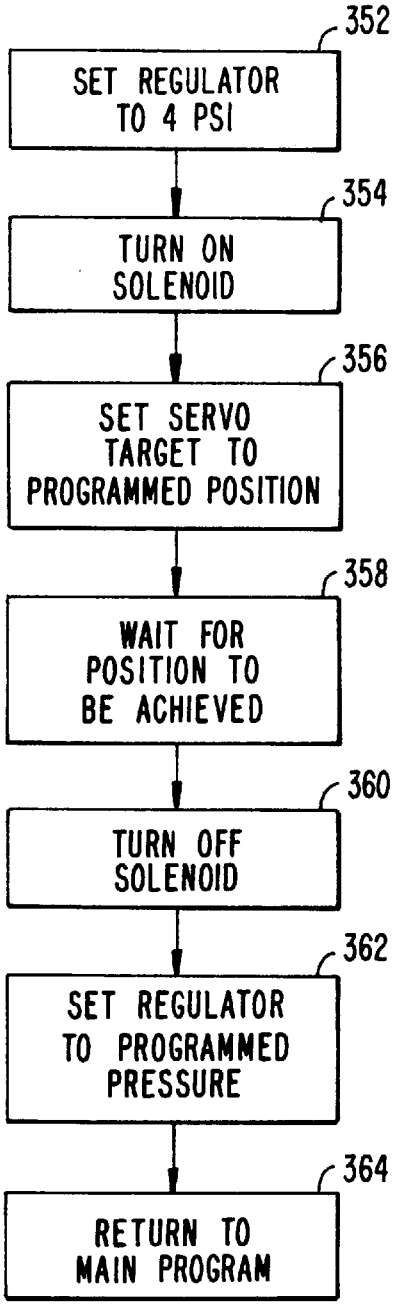
FIG. 13 is a flow diagram of the process for positioning the impulse bar.

Impulse bar position subroutine is illustrated at FIG. 13. In this subroutine, the system first sets the regulator to four pounds per square inch (352), using impulse regulator 252 under control of the 8051 microprocessor 200. Next (354), the system activates impulse solenoid 250. Then microprocessor 200 sets the servo target to its programmed position. After delay (358) waiting for the impulse bar position to be achieved, the impulse solenoid 250 is turned off (360). Next (362), the system sets the regulator 252 to the programmed pressure and returns to the main program (364).

b. Return To Main Scribe Only Program

Figure 10A:
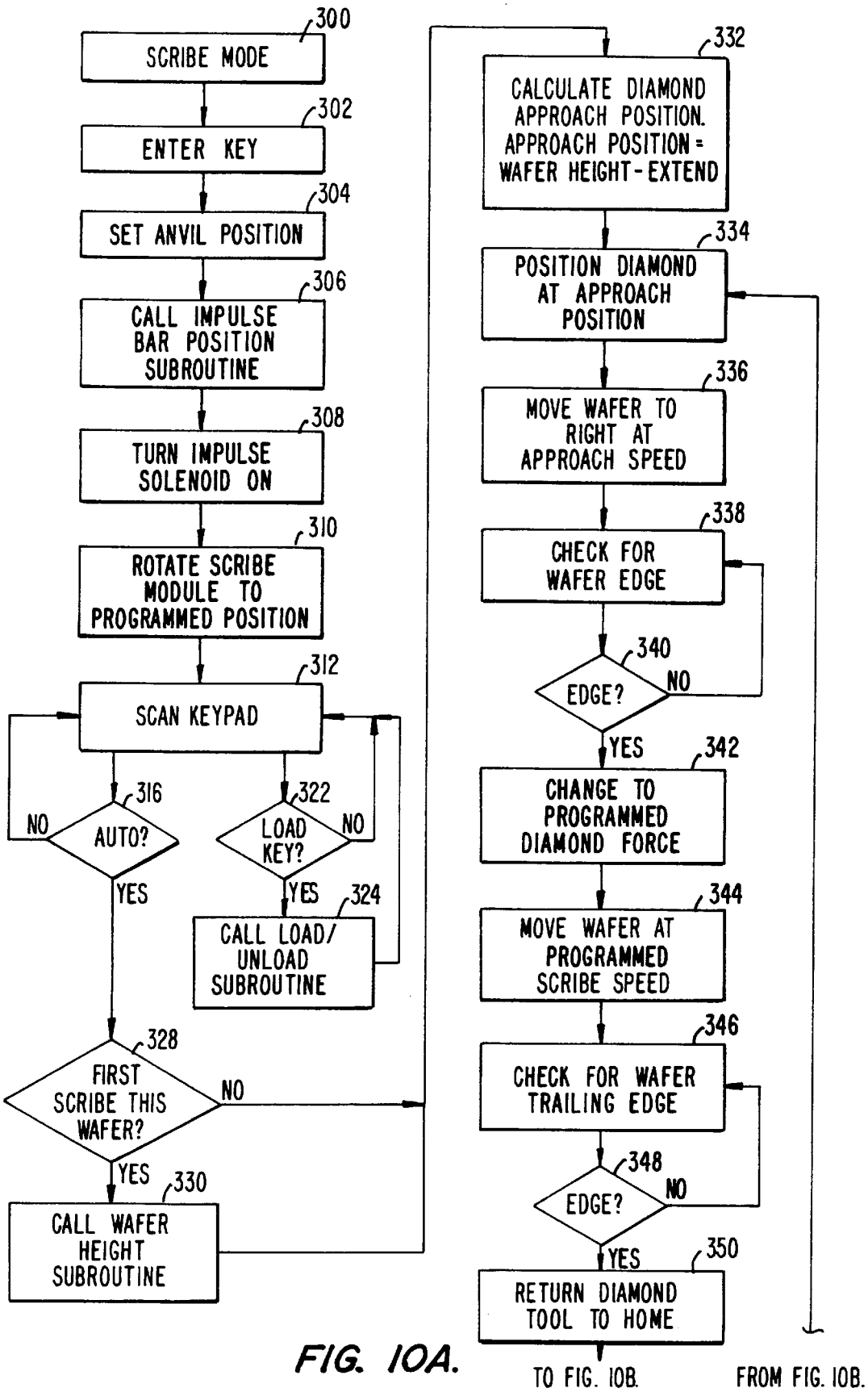
FIG. 10A is a flow diagram of the process for the Scribe Only Mode.

As shown in FIG. 10A, once the impulse bar position subroutine (306) has been accomplished, the system turns on the impulse solenoid 250 (308), and the scribe module 20 is rotated into programmed five o'clock position (310).

c. Loading A Wafer

The keypad is scanned (312). If the LOAD key 55 has been pressed, the system calls the LOAD/UNLOAD subroutine illustrated at FIG. 14 (324). First, the system checks the position of the scribe module 20 (380). If the module 20 is in "Home" position, i.e., at 3:00 o'clock (382), the system turns on the vacuum by activating vacuum solenoid 248 (384). A wafer is next loaded onto the vacuum chuck 18, and the vacuum draws the wafer securely down onto the chuck. The system next rotates the scribe module 20 to the programmed angle (386). The wafer is moved in the X and/or Y directions to position it under the camera lens 19 (388). Next, the wafer is cycled left to right to obtain theta alignment.

d. Alignment Of Wafer During Loading

The operator uses theta knob 75 to control theta motor 232 to obtain angular (theta) alignment (390). Once theta alignment is achieved, the operator presses the CLEAR key 52 (392) which signals the system to move the table to the position for beginning scribing (394) and return to the main scribe program (396)

Having returned to the main program, the system again scans the keypad (312). If the AUTO key has been pressed (316), the system decides whether this is the first time this wafer has been scribed (328). If so, the wafer height of this wafer must be determined before it can be scribed, and thus the system calls up the wafer height subroutine (330) shown in FIG. 12. If the wafer has already been scribed once (e.g., manually, in a test scribe) the system skips the wafer height subroutine and proceeds to calculate the diamond approach position, calculated as wafer height less diamond tool extension (332).

e. Scribe Tool Wafer Sense Subroutine

The objective of the scribe tool wafer sense subroutine is to use the cutting tool 24 of the scribe module 20 to determine the height of the wafer 34. Thus, prior to scribing a wafer, the scribe tool descends to determine the exact position of the top of the wafer. This occurs after each time a wafer is loaded in order to accommodate variations in wafer thickness. To perform a MANUAL SCRIBE, the operator must first position the wafer so that the scribe tool descends onto the tape next to the right edge of the wafer. Upon pressing the manual key 71, the screen will display:

POSITION WAFER UNDER SCRIBE.
THEN PRESS MANUAL.

The operator uses the X-Y joystick to move the X table so that the scribe will descend onto the top surface of the wafer, and then once again presses the manual key 71. The diamond cutting tool 24 will descend onto the top of the wafer and stop. When it is done calibrating, it retracts and the X stage moves to the previous position off the wafer (step 36).

f. Begin Scribing: Edge Detection

Scribing begins with the diamond cutting tool extended. The X-Y table moves the wafer towards the scribe at approach speed. Once the scribe 24 detects the edge of the wafer, the table will accelerate to the programmed scribe speed and the scribe will switch to the force control loop for wafer scribing. The scribe can be viewed on video as it occurs. The scribe tool 24 detects the moment that the scribe tool falls off the edge of the wafer and ends the scribe. The X-table then returns the stage ready for another scribe. The Y-table will not index.

g. Actual Scribing: Auto

To automatically scribe the wafer, press the auto key 72. If the scribe has not previously calibrated the top position of the wafer, it will do so now. Scribing will end when the programmed wafer size is reached or when the auto key 72 is again pressed. Having completed the wafer height subroutine (330), the system next calculates the diamond approach position as equal to the difference between wafer height and scribe extension (step 332). Once that calculation is made, the diamond tool 24 is positioned at the approach position to the right of the wafer (334). Next, the X-Y table moves the wafer in the right-hand direction at approach speed (336). The system waits for the tool 24 to touch the wafer edge (338, 340). Once the edge is detected, the system sets the pre-programmed scribe force (342), and then moves the wafer past the tool at the programmed scribe speed (344), causing the tool to scribe the wafer. The system constantly monitors for the wafer trailing edge by waiting for the diamond scribe tool to fall off the wafer edge (346, 348). Once the edge is so detected, the diamond tool is returned to home position (350). The wafer is then returned to start position by X-axis motor 226 and X axis encoder 224 (331). If the autokey 23 has not been pressed again to end this sequence (333,335) the system moves the wafer one step in the Y direction by programmed amount X (341), and returns the diamond to its approach position (334) to continue scribing additional scribes along the X-axis.

2. Wafer Height Subroutine

Figure 12:
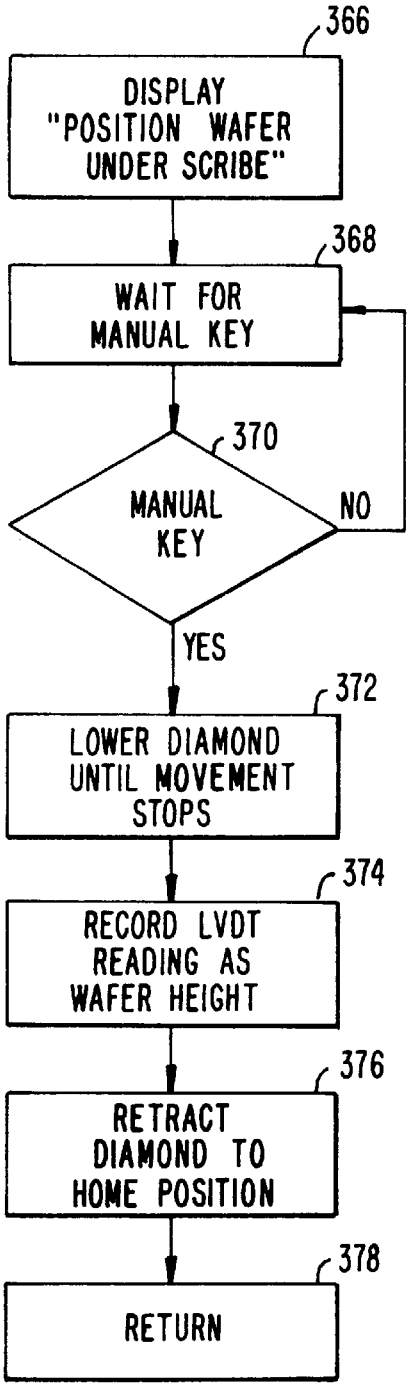
FIG. 12 is a flow diagram of the process for sensing wafer height with the tip of the scribe tool.

The objective of the wafer height subroutine is to use the scribe module 20 to determine the thickness of the wafer before or during SCRIBE mode. This subroutine is shown at FIG. 12.

When the system determines that the wafer has not previously been scribed, it directs the chosen wafer to be placed under the scribe tool 24 (366), and waits for the "Manual" key 22 to be pressed by the operator (368). When the manual key 22 is pressed, the voice coil motor lowers the tool 24 until it touches the wafer surface and stops (372). The tool is determined to be stopped when there are no additional changes in diamond position with increase in force generated by voice coil. The system then records the corresponding LVDT reading as wafer height (374), retract the diamond tool to home position (376), and returns to the main program (378).

C. BREAK ONLY MODE

Figure 15:
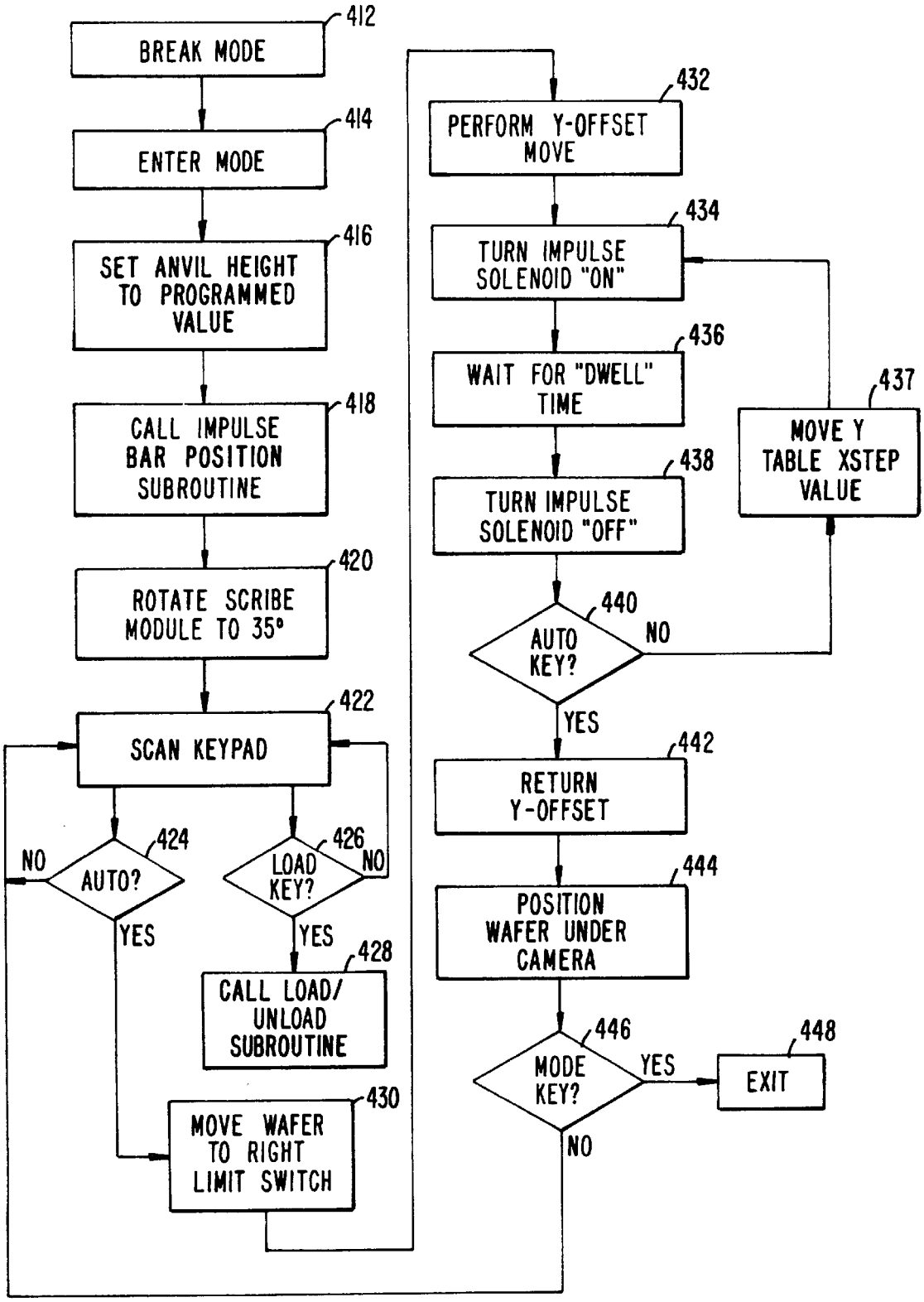
FIG. 15 is a flow diagram of the process for the Break Only Mode.

BREAK ONLY mode is illustrated in FIG. 15.

Break Mode is used to break the wafer after it has been scribed, either on the machine of the present invention or elsewhere.

To enter the Break Only Mode, the operator presses the mode key 44 until the "break mode" appears (412). The operator then presses the enter key 48 (412, 414) to enter the break mode.

Figure 14:
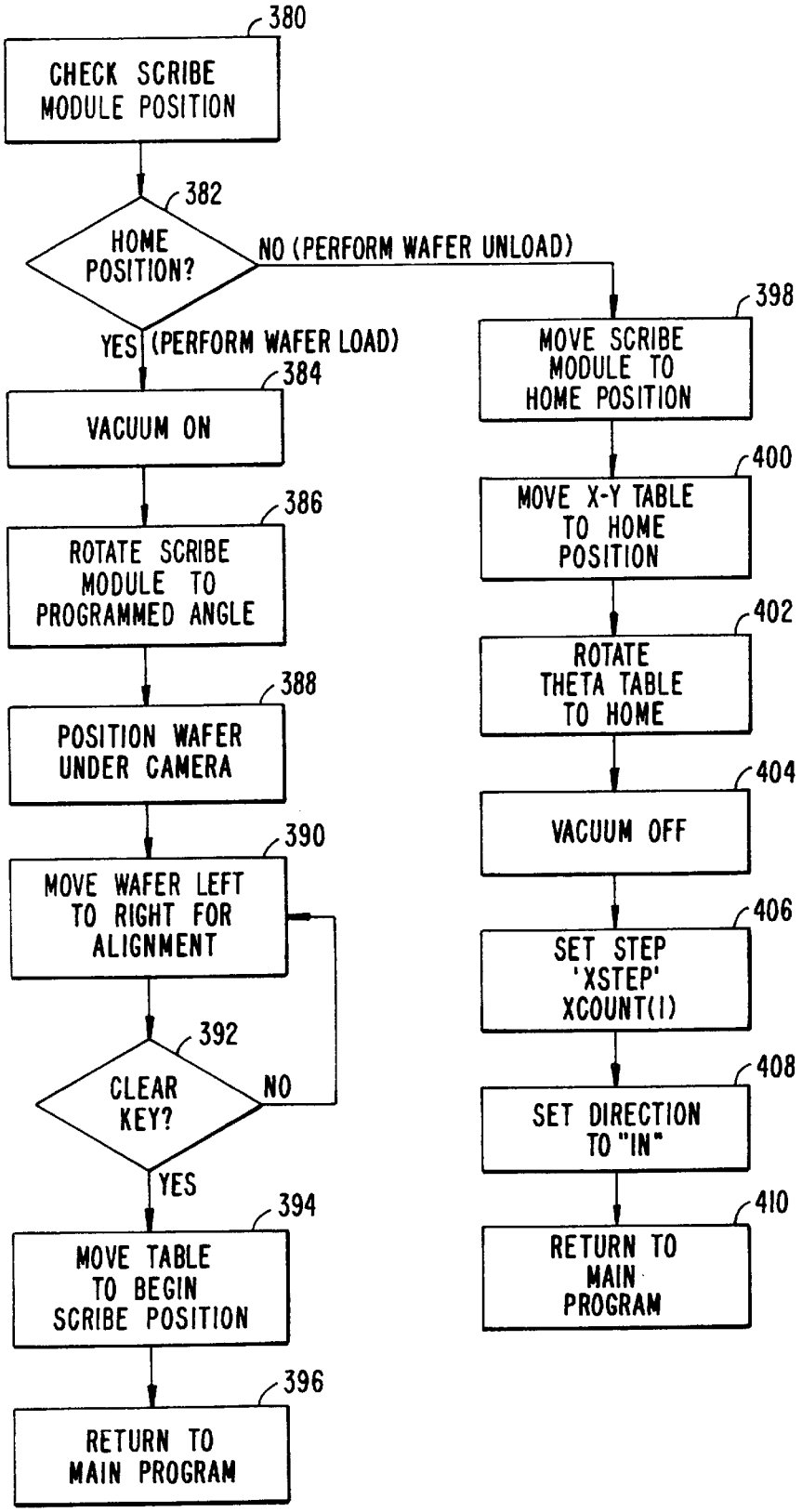
FIG. 14 is a flow diagram of the process for loading and/or unloading a wafer from the wafer chuck.

In response, the system sets the height of the anvil 26 to a preprogrammed value (416). Next, the system calls up the impulse bar position subroutine discussed and described in connection with FIG. 13. The system then rotates the scribe module to a position in which the angle of the cutting tool 24 is at 35° to the vertical axis perpendicular to the surface of the wafer (420). The machine now scans the keypad to determine which keys have been activated (422). If the load key 55 has been pressed (426), the system calls the load/unload subroutine (428) which is illustrated at FIG. 14. At the outset, the system checks to see if the scribe module is in home position (380, 382). Home position for the scribe module is at the three o'clock position, i.e., with the cutting tool pointing in a horizontal direction toward the control panel (10). The scribe module rotates to the home position for each unload. If the scribe module is in home position, the system first turns on the vacuum to the wafer-holding chuck 18 (384), then rotates the scribe module to the programmed scribe angle (386), then positions the wafer 34 under the camera 14 and then causes the X-table to move the wafer from left to right for alignment of the wafer streets with the scribe.

a. Alignment

This operation may be done manually by the operator, observing the position of the wafer streets on the cross-hair on the video monitor 12. The operator may adjust the wafer in the Y direction to bring the wafer into alignment by means of the X-Y toggle switch 74. Alternatively, this alignment could be performed automatically by programming the 386-based computer with pattern recognition software. The wafer will continue to move from side to side for alignment until the operator presses the clear key 52 (392), after which the system moves the wafer table to its position for beginning the scribing operation (394) and returns to the main BREAK ONLY program, illustrated at FIG. 15.

The system scans the keypad auto key 72 (424). If the auto key has been pressed, the system moves the wafer in the right-hand (X) direction until its motion is stopped by tripping the X-limit right microswitch 268 (430). At this point, the wafer is now positioned underneath the anvil 26 and above the impulse bar 28. Next, the system performs the Y-offset move (432) to bring the scribe line into perfect vertical alignment above the sharp edge 30 of the impulse bar 28. Next, the system activates the impulse solenoid 250 (434), causing the impulse bar to be driven upwardly into contact with the bottom surface of the wafer 34. The impulse bar remains in that position for the predetermined dwell time (436) and then the impulse solenoid 250 shuts off, allowing the impulse bar to return to its down position (438). If the auto key 72 has not been pressed, the system moves the Y-table a single programmed step in the Y-direction (437) and the breaking process is repeated with the impulse solenoid turned on (434), the impulse bar striking the bottom edge of the wafer; the impulse bar remaining in contact with the bottom edge of the wafer during the dwell time (436), and then the impulse solenoid shutting off (438) causing the impulse bar to return to its down position. In this fashion, so long as the auto key is not pressed at the end of a breaking sequence, the machine continues to break scribe after scribe after until all X-oriented scribes have been broken. If the auto key is depressed following a breaking sequence, the system returns the table to the original X position, before correcting for the Y-offset (442) and positions the wafer under the camera 14 (444). If the mode key 44 has been pressed and the operator has chosen to leave the break mode by entering a different mode or ending the operation, the system exits the program (448). If there is no change in the mode, the system continues in the break mode and returns to scanning the keypad (422) to determine whether or not to continue breaking the wafer 34. In other words, by pressing the auto key, the system begins to automatically break the wafer indexing one step at a time in the Y-direction. Automatic breaking will cease as soon as the auto key is pressed a second time. Alternatively, the machine will stop breaking when the program wafer size is reached or the Y limit switch is triggered. To rotate the wafer, the operator presses the rotate key 53. This causes the vacuum table to rotate ninety degrees to permit the water to be broken along those scribes perpendicular to the original scribes broken.

Alternatively, the system can be programmed to automatically rotate the wafer once the programmed wafer size is reached or the limit switch is triggered.

b. Unload Subroutine

Once the wafer breaking operation has been completed, the load key 55 is depressed a second time (426) whereupon the machine calls the load-unload subroutine (FIG. 14). The system first checks the scribe module position (380). If the scribe module is not in home position, this indicates to the machine that a wafer is in place, for unloading (382). Thus, the system rotates the scribe module to home position (398) to move the diamond cutting tool 24 out of harm's way and provide clearance for removal of the wafer. Next, the X-Y table is moved to home position (400), i.e., moved in the X-direction until it encounters the X-limit left microswitch 266. This moves the wafer chuck 18 out from under the camera 14 and scribe module 20 (400). Next, the wafer chuck 18 is rotated to home position (402). Vacuum to the vacuum chuck is turned off (404). The X-step counter is reset to X-count one (406). The table direction is set to "in" ready for the next wafer and the system returns to the main break mode program (410).

The system is now ready to accept a new wafer. The system again scans the keypad to see if the load key has been depressed and, if so, calls up the load subroutine once again. If the scribe module is in the home position (380, 382), the system is ready to accept a new wafer or it may be shut down.

D. SCRIBE AND BREAK MODE

Figure 16:
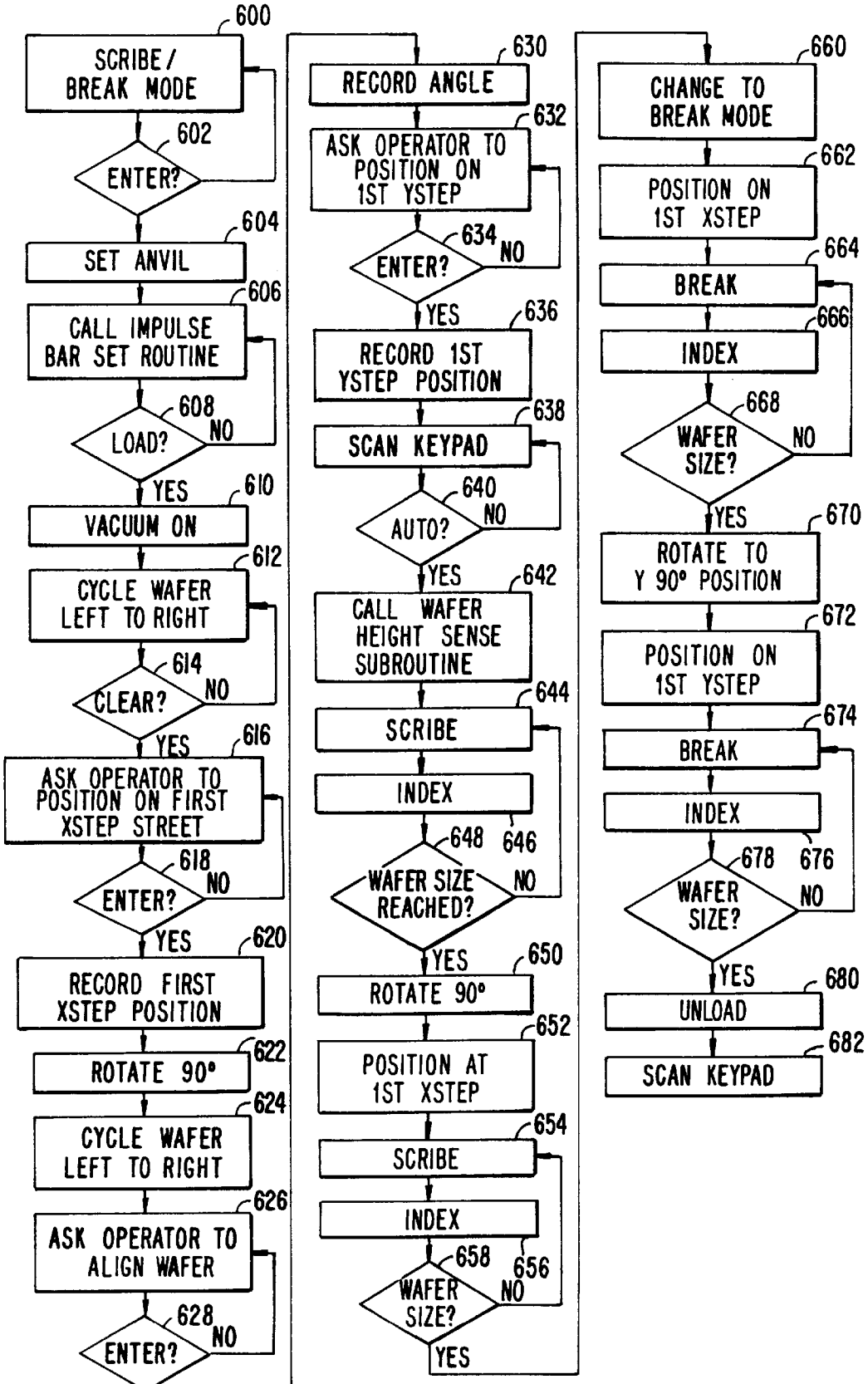
FIG. 16 is a flow diagram of the process for the Scribe and Break Mode.

The scribe and break mode is illustrated by FIG. 16. Scribe/break mode is used to scribe and break a wafer in semiautomatic fashion.

After the operator aligns the wafer for the X-STEP (first) direction, the table rotates and the Y-STEP (second) direction is aligned. From that point on the scribing/breaking process is performed without further operator intervention. To enter the scribe/break mode, press the mode key 44 until the SCRIBE/BREAK MODE menu appears as follows (600):

```
SCRIBE/BRAKE MODE
WAFER: 1.    WAFER: 01
CONTINUOUS
F: 1650    A: 29.5    S: 0500
```

Press the wafer key 54 until the desired wafer name appears, then press enter (602). At this point the system automatically sets the scribe parameters, including the anvil setting 604 and the impulse bar set routine 606. After the scribing parameters are set, the scribe rotates into scribing position (five o'clock).

When positioning of the anvil, impulse bar and scribe module is complete, the system is ready for wafer loading and alignment (608). To load a wafer, the scribe module must be in raised position (at three o'clock). This is accomplished by pressing the load key 55 (608). The operator next places the wafer on the vacuum chuck with the wafer positioned so that the X-step street is parallel with the horizontal cross-hair to within five degrees. Having properly positioned the wafer 34 on the vacuum chuck 18, the operator presses the load key 55 (608). The system automatically turns on the vacuum for the wafer chuck (610) and the table begins to move so that the center of the wafer is under the camera and begins to cycle left to right (612). The operator uses the theta knob 75 to align the wafer parallel with the cross-hair and, once this accomplished, presses enter 48 (618). To stop the side to side movement and enter the water manually, press clear (614) and then, when the wafer is aligned, press enter (618). The Y-table will then move to the front and display the following menu:

```
USE Y JOG KEYS
TO POSITION CROSS-HAIR
ON FIRST X-STEP STREET
THEN PRESS ENTER
```

Use the Y jog keys 47 to align the first X-step street with the cross-hair and then press enter 48 (620). The wafer will automatically rotate ninety degrees (622) and the following menu will be displayed:

```
USE Y JOG KEYS
TO POSITION CROSS-HAIR
ON FIRST Y STEP STREET
THEN PRESS ENTER
```

Use the Y jog keys 47 (624) to align the first Y-step street (632) with the horizontal cross-hair (626), then press enter (628). The alignment procedure is now complete. At this time, the manual key 71 can be used to perform a test scribe or the auto key 72 can be used to begin automatic processing of the wafer (640). To perform a test scribe, press manual key 71. Wafer height subroutine 642 is called to determine wafer height. The diamond will extend and the wafer will move to the right. The test scribe can be viewed on the monitor as it is taking place. After the scribe is complete, the stage will return, ready for another scribe. It will not index. To begin the automatic processing of a wafer press auto key 72 whereupon the following menu is displayed:

1. WAFER 01
Y STEP (01) 0040.0 MILS
Y COUNT (001)
PRESS AUTO TO STOP

Press the auto key 72 to stop at any time, then press the auto key 72 to resume at the current position. After the first direction of the wafer has been scribed, it will rotate ninety degrees and the Y table will move to the forward position. The second direction will then be scribed. After the second direction has been scribed, the wafer will move to the right and the current direction will then be broken. The wafer will rotate ninety degrees and the final direction will be broken. When the wafer is complete, it will move to the load position, ready for removal. To process the next wafer, repeat the above procedure.

D. Changing The Diamond Tool and Y-Offset Subroutine

Figure 11:
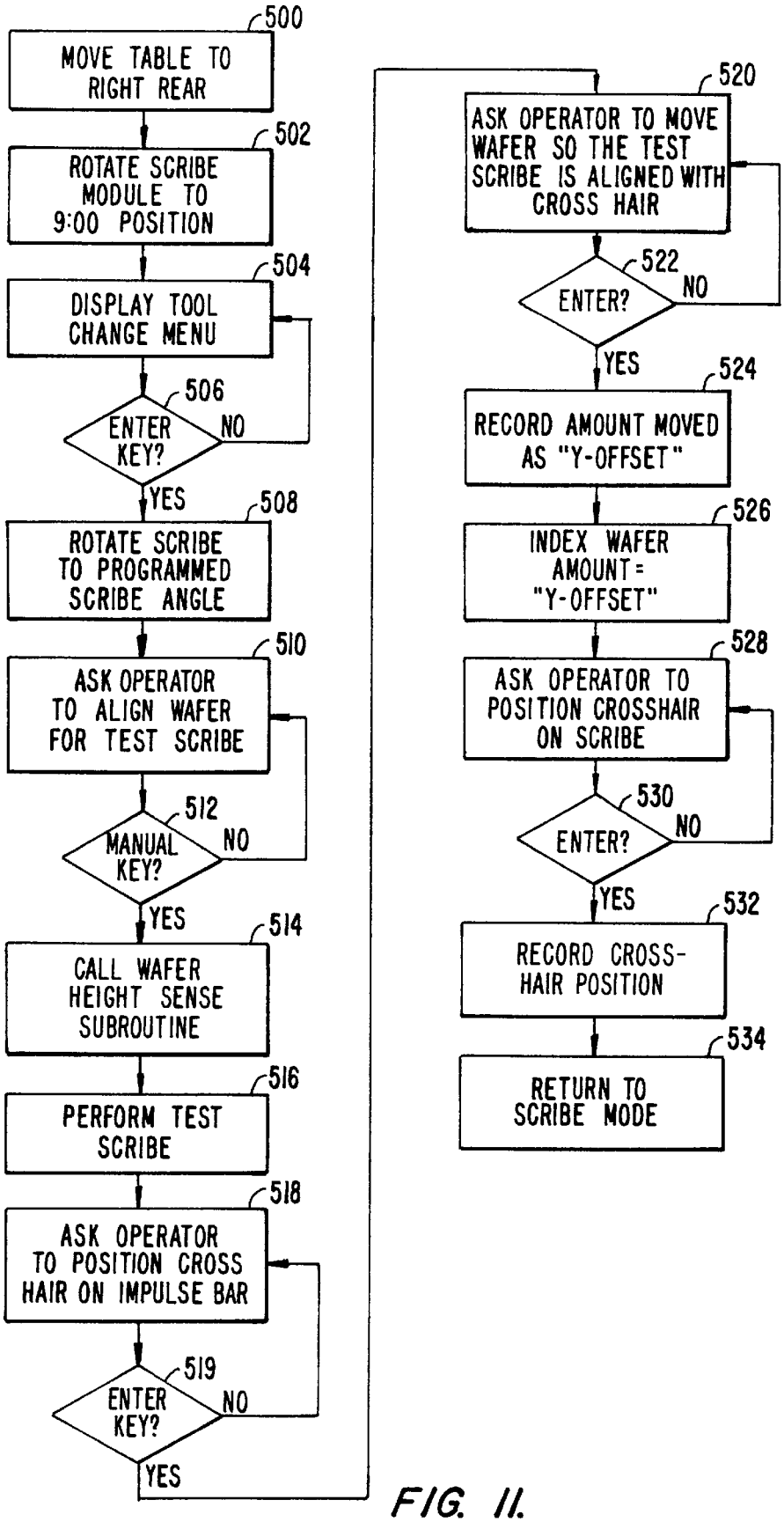
FIG. 11 is a flow diagram of the process for changing the diamond-tipped tool of the scribe module, including the Y-offset correction.

The process of changing the diamond tool, together with the Y offset calculation, is illustrated at FIG. 11.

The purpose of the diamond tool change is to replace and/or rotate the diamond tool when it becomes worn. The purpose of the Y offset calculation is to correct for misalignment of the cutting edge of the scribe tool 24 and the sharp edge 30 of the impulse bar 28.

The diamond tool change is initiated by moving the X-Y table to the right rear (500). Next, the scribe module is rotated to the 9 o'clock position. The system then displays the tool change menu (504). While the scribe module is in the 9 o'clock position, the operator may change and/or rotate the diamond tip cutting tool 24. When this operation is complete, the operator presses the enter key 48 on the touchpad 11 (506), whereupon the scribe rotates to its programmed scribe angle (508). Next, the menu asks the operator to align the wafer for a test scribe (510). When the operator is ready to perform a test scribe, he or she presses the manual key 71 (512), whereupon the system calls the wafer height sense subroutine (514) (see FIG. 12).

Following completion of the wafer height sense subroutine, the system performs the test scribe (516). The test scribe is a single scribe performed on a wafer. Next the menu asks the operator to position the cross-hair on the image of the impulse bar edge 30. When the operator has completed alignment of the cross-hair with the bar edge, he or she presses the enter key 48 on the touchpad 11 (519). Next the system asks the operator to move the wafer in the Y direction so the test scribe is aligned with the cross-hair (520). Once this is accomplished, the operator presses the enter key 48 of touchpad 11 (521). The system then records in memory the amount by which the table was moved in the Y direction to align the test scribe with the cross-hair as described at 520. (This dimension is sometimes herein referred to as the "Y offset") (524). Next, the system indexes the wafer in the Y direction by an amount equal to the so-called "Y offset" (526). The operator is then asked to position the cross-hair on the test scribe line (528). Once the operator has accomplished this, he or she presses the enter button 48 on the touchpad 11 (530) whereupon the system records the cross-hair position which corresponds to the line along which the scribe tool actually draws a scribe (532). Once this is accomplished, the system is returned to the scribe mode (534). With conventional pattern recognition software techniques, for which the system is readily suited, all of the foregoing steps in FIG. 13 which require operator intervention could be modified so that the role of the operator is performed by pattern recognition. In this fashion, the entire routine (except for changing the tool) could be carried out automatically without operator intervention.

E. ELECTRONICS SYSTEM

FIG. 17 is a block diagram of the electronic components of the scriber breaker system of the present invention.

The central component of the system is an Intel 8051 microprocessor board 200 which includes an 8051 microprocessor, RAM, ROM and other conventional components. The 8051 microprocessor board 200 is driven by DC power supply 204 and receives operator input from keypad 11. The 8051 microprocessor board 200 communicates to the motor controller board 202. The 8051 microprocessor board 200 also receives operator input from the X-Y joystick 208 and theta adjust knob 206 (also referred to as 74 and 75 in FIG. 2).

The 8051 microprocessor board 200 communicates with the vacuum solenoid 248, the impulse solenoid 250, impulse regulator 252, inlet solenoid 254, scribe angle brake 256, scribe load cell 258, scribe limit, home, 260, Y limit, rear, 262, Y limit, front, 264, X limit, left, 266, X limit, right, 268, theta home limit 270.

The motor controller board 202 communicates with the Y axis encoder 220, Y axis motor 22, X axis encoder 224, X axis motor 226, scribe angle motor 228, scribe angle encoder 230, theta motor 232, theta encoder 234, gap motor 236, gap position 238, anvil motor 240, anvil position sensor 242, voice coil 244 and scribe position sensor 246.

Together boards 200, 202 control operation of the scriber breaker machine of the present invention. The 8051 microprocessor board 200 communicates to and from the IBM 386 computer via serial link. The IBM 386 computer 210 in turn communicates with floppy drive 214, video imaging board 212 and color monitor 12.

The video imaging board receives input from the color camera 14, which in turn receives input from the zoom lens 15.

The 8051 microprocessor board 200, IBM 386 computer 210, video imaging board 212, color camera 14 and color monitor 12 all receive direct current power from the DC power supply 204.

The Y axis encoder 220 is a linear encoder used to measure the position of the X-Y table in the Y direction, i.e. the wafer position in the Y direction.

The Y axis motor 222 is a DC motor used to rotate the Y axis screw to drive the X-Y table in the Y direction.

The X axis encoder 224 is a rotary encoder used to position the X axis of the X-Y table, i.e. the X position of the wafer.

The X axis encoder 224 and X axis motor 226 cooperate to drive and position the wafer along the X axis during scribing and, in addition, position the wafer under the anvil for breaking during the breaking operation.

The Y axis encoder 220 and Y axis motor 222 cooperate to index the wafer in the Y direction from street to street during both scribing and breaking.

The scribe angle motor 228 is used to position the angle of the scribe vis-a-vis the surface of the wafer. Scribe angle motor 228 uses feedback from scribe angle encoder 230 to reach the desired scribe angle position. The theta motor 232 drives the vacuum wafer holding chuck 18 in the theta or rotational direction to align the wafer with the impulse bar and anvil during scribing and/or breaking, and also to rotate the wafer 90 degrees during scribing and breaking. The theta encoder 234 provides feedback to ensure that angular movement of the wafer chuck moves to the correct angular position selected by the computer. The paired motor encoders 220-222, 224-226, 228-230, 232-234, 236-238, 240-242, 244-246 all operate in a servo loop to position the various devices with which they are associated. Gap motor 236, with gap position sensor 238, positions the impulse bar STOP. The stop limits movement of the impulse bar in the vertical direction for both scribing and breaking, to programmed values.

The anvil motor 240 and anvil position sensor 242 are used to position the anvil in the vertical direction during both scribing and breaking. The voice coil 234 and scribe position 246 cooperate to position the diamond cutting tool 24. The vacuum solenoid 248 is used to turn vacuum on and off to the vacuum wafer holding chuck 18. The function of the vacuum is to hold a wafer securely on the chuck during scribing and breaking.

The impulse solenoid 250 allows air to enter the impulse bar diaphragm cavity 37, which in turn causes the impulse bar to move to its "up" position. Impulse bar regulator 252 is used to control the pressure of air flowing to the impulse bar 28 flowing through the impulse solenoid 250.

Inlet solenoid 254 is used to turn on air to the system when the scriber breaker machine is turned on.

The scribe angle brake 256 is used to brake the rotational movement of the scribe module 20 once it has reached its correct angular position. The scribe load cell 258 is used to measure the force applied on the wafer through the diamond scribe tip 24 by the voice coil 56. The scribe limit, home 260 is a microswitch serving to detect and limit movement of the scribe in the rotational movement of the scribe module 20 when it achieves the three o'clock position. The Y limit, rear 262 is a microswitch used to detect the rearmost position of the X-Y table in the Y direction. The Y limit, front 264 is a microswitch used to detect and limit the movement of the X-Y table in the frontmost position along the Y axis.

The X limit, left 266 is a microswitch positioned to detect and limit the movement of the X-Y table in the leftmost position of the X-Y table in the X direction.

The X limit, right 268 is a microswitch positioned to detect and limit the rightmost movement of the X-Y table in the X direction.

The theta home limit 270 is a microswitch used to detect and limit the counter-clockwise movement of the theta table (vacuum wafer holding chuck 18). Theta adjust 206 is a digital encoder used by the operator align the streets of the wafer parallel to the cross-hair image on color monitor 12. X-Y joystick 208 is a two-axis variable resistor used by the operator to move the X-Y table in the X-Y directions.

The IBM 80386 computer 210 uses instructions loaded on the floppy drive 214 to digitize the image received by the color camera 14 from the zoom lens 15 and processed through the video imaging board 212. The computer 210 is also used to create and superimpose a cross-hair or other visual frame of reference on said image from the color camera 14 and display the combination thereof on color monitor 12 in order to permit the operator to align the wafer for scribing or breaking. In addition, the computer 210 may be used to perform the foregoing functions via conventional pattern recognition techniques. In addition, computer 210 receives instructions from microprocessor board 200 and displays menus on the color monitor 12 in accordance therewith.

The keypad 11 is a touchpad input device used by the operator to input numeric and functional instructions in order to program the scriber breaker machine with all parameters necessary for the device to perform scribing and breaking operations continuously and without operator intervention.

Other modifications and variations can be made to the disclosed embodiments without departing from the subject of the invention as defined in the following claims.

What is claimed is:

1. Apparatus for automatic scribing and breaking of semiconductor wafers comprising:

a. a base unit;

b. a first table, mounted on the base unit for reciprocal movement along a first axis between first and second first table positions corresponding to a scribing station and a breaking station respectively;

c. a second table mounted on the first table for reciprocal movement along a second axis perpendicular to said first axis, said second table having an aperture communicating between said first table and a third table;

d. the third table mounted on the second table for angular movement about a third axis perpendicular to both said first and second axes, said third table having a central opening and adapted to hold a semiconductor wafer having upper and lower surfaces both while lines are being scribed on the upper wafer surface and while the wafer is being broken at said scribe lines;

e. an impulse bar having an upper straight sharp edge mounted on the first table for reciprocal movement between first and second impulse bar positions parallel to said third axis, said first impulse bar position characterized by the upper edge of said impulse bar protruding through the central opening of said third table to a point above the upper surface of said third table, so that said upper edge will apply force along a line to the lower surface of a wafer held on the third table during both scribing and breaking;

f. the breaking station including resistance means for resisting upward movement of a wafer held on the third table during application of force to the lower surface of the wafer by said impulse bar;

g. the scribing station including a scribe tool having a cutting edge, said scribe tool mounted above said third table for movement between first and second scribe tool positions, the first said scribe tool position characterized by the scribe tool cutting edge positioned below the plane of the upper surface of a wafer held on the third table to apply a cutting force to the upper surface of said wafer when said first table is driven beneath said wafer along said first axis, and the second said scribe tool position characterized by the scribe tool cutting edge being positioned at a location where it will not touch the upper surface of the wafer when the wafer is urged upwardly from beneath by said impulse bar;

h. a first drive motor to drive said first table along said first axis between said scribing and breaking stations, and during scribing of the wafer with the scribe tool;

i. a second drive motor to drive said second table along said second axis in stepped increments so that spaced parallel scribe lines may be applied to said wafer; and, j. a third drive motor to drive said third table in rotation about said third axis for angular alignment of said wafer with said first and second axes.

2. The apparatus of claim 1 wherein said resistance means is an anvil positioned above the wafer at a separate location from where said wafer is scribed.

3. The apparatus of claim 1 further comprising a computer control operatively connected to said first, second, and third motors, said breaking station and said scribing station, the computer control including memory means to contain operating parameters for automatic scribing and breaking operations once said wafer has been mounted on said third table.

4. The apparatus of claim 3 wherein at least one of the operating parameters are selected from the group including:

dwell time, anvil height, wafer diameter, wafer thickness, force applied to impulse bar, force to be applied to the wafer by the tip of the scribe during scribing, gap between wafer impulse bar and anvil, wafer thickness, scribe extension, impulse bar height, scribe angle, scribe speed, wafer edge approach speed, scribe type, cycle time, X-step, and Y-step.

5. The apparatus of claim 4 wherein said scribe tool includes a voice coil for controlling scribe extension and force to be applied to the wafer during scribing.

6. The apparatus of claim 3 wherein said scribe tool includes a voice coil for controlling scribe extension and force to be applied to the wafer during scribing.

7. The apparatus of claim 1 wherein said scribe tool includes a voice coil for controlling scribe extension and force to be applied to the wafer during scribing.

8. Apparatus for automatic scribing of semiconductor wafers comprising:

a. a base unit;

b. a first table, mounted on the base unit for reciprocal movement along a first axis between a scribing station and a breaking station;

c. a second table mounted on the first table for reciprocal movement along a second axis perpendicular to said first axis, said second table having an aperture communicating between said first table and an annular third table;

d. the third table mounted on the second table for angular movement about a third axis perpendicular to both said first and second axes, said third table having a central opening and adapted to hold a semiconductor wafer having upper and lower surfaces while lines are being scribed on the wafer surface;

e. an impulse bar having an upper straight sharp edge mounted on the first table for reciprocal movement between first and second impulse bar positions parallel to said third axis, said first impulse bar position characterized by the upper edge of said impulse bar protruding through the central opening of said third table to a point above the upper surface of said third table, so that said upper edge will apply force along a line to the lower surface of a wafer held on the third table to place the opposed upper surface of said wafer under tension for scribing;

f. the breaking station including resistance means for resisting upward movement of a wafer held on the third table during application of force to the lower surface of the wafer by said impulse bar;

g. the scribing station including a scribe tool having a cutting edge, said scribe tool mounted above said third table for movement between first and second scribe tool positions, the first said scribe tool position characterized by the scribe tool cutting edge positioned below the plane of the upper surface of a wafer held on the third table to apply a cutting force to the upper surface of said wafer when said first table is driven beneath said wafer along said first axis, and the second said scribe tool position characterized by the scribe tool cutting edge being positioned at a location where it will not touch the upper surface of the wafer when the wafer is urged upwardly from beneath by said impulse bar;

h. a first drive motor to drive said first table along said first axis during scribing of the wafer with the scribe tool;

i. a second drive motor to drive said second table along said second axis in stepped increments so that spaced parallel scribe lines may be applied to said wafer; and, j. a third drive motor to drive said third table in rotation about said third axis for angular alignment of said wafer with the first and second axes.

9. The apparatus of claim 8 further comprising a computer control operatively connected to said first, second, and third motors, said breaking station and said scribing station, the computer control including memory means to contain operating parameters for automatic scribing operations once said wafer has been mounted on said third table.

10. The apparatus of claim 9 wherein at least one of the operating parameters are selected from the group including: dwell time, anvil height, wafer diameter, wafer thickness, force applied to impulse bar, force to be applied to the wafer by the tip of the scribe during scribing, wafer thickness, scribe extension, impulse bar height, scribe angle, scribe speed, wafer edge approach speed, scribe type, cycle time, X-step, and Y-step.

11. The apparatus of claim 10 wherein said scribe tool includes a voice coil for controlling scribe extension and force to be applied to the wafer during scribing.

12. The apparatus of claim 9 wherein said scribe tool includes a voice coil for controlling scribe extension and force to be applied to the wafer during scribing.

13. The apparatus of claim 8 wherein said scribe tool includes a voice coil for controlling scribe extension and force to be applied to the wafer during scribing.

* * * * *